US007801464B2

(12) United States Patent
Kagawa et al.

(10) Patent No.: US 7,801,464 B2
(45) Date of Patent: Sep. 21, 2010

(54) ION GENERATING DEVICE WITH A DISCHARGE ELECTRODE ON A DIELECTRIC BODY COATED BY A PROTECTIVE LAYER MADE OF METAL

(75) Inventors: Toshiaki Kagawa, Kitakatsuragi-gun (JP); Shogo Yokota, Fujiidera (JP); Katsumi Adachi, Ikoma-gun (JP); Masashi Hirai, Katano (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/185,300

(22) Filed: Aug. 4, 2008

(65) Prior Publication Data

US 2009/0039244 A1 Feb. 12, 2009

(30) Foreign Application Priority Data

Aug. 6, 2007 (JP) ..... 2007-204791

(51) Int. Cl.
*G03G 15/02* (2006.01)
*G03D 15/06* (2006.01)

(52) U.S. Cl. ..... 399/168; 346/150.2

(58) Field of Classification Search ..... 399/50, 399/115, 168; 346/50.2; 347/127–128; 250/281, 285
See application file for complete search history.

(56) References Cited

U.S. PATENT DOCUMENTS 3,483,374 A * 12/1969 Dietrich ..... 250/324
3,970,905 A 7/1976 Itoh et al.
4,783,716 A 11/1988 Nagase et al.
5,138,348 A * 8/1992 Hosaka et al. ..... 347/128
5,202,705 A * 4/1993 Asano et al. ..... 347/127
5,239,317 A * 8/1993 Hosaka et al. ..... 347/127
5,367,366 A 11/1994 Kido et al.
5,646,669 A * 7/1997 Yamada et al. ..... 347/127
5,983,060 A 11/1999 Namekata et al.
6,024,930 A * 2/2000 Racca et al. ..... 422/186.07
6,239,823 B1 * 5/2001 Fotland ..... 347/127

FOREIGN PATENT DOCUMENTS

JP 57-006385 2/1982
JP 60-232570 11/1985
JP 61-231573 A 10/1986
JP 63-21673 1/1988
JP 03088702 A * 4/1991
JP 06-11946 1/1994
JP 08-001988 1/1996
JP 8-160711 6/1996
JP 08-240968 9/1996
JP 08-258323 10/1996
JP 10-274892 10/1998
JP 11-40316 A 2/1999

(Continued)

*Primary Examiner*—David M Gray
*Assistant Examiner*—Billy J Lactaoen
(74) *Attorney, Agent, or Firm*—Nixon & Vanderhye P.C.

(57) ABSTRACT

A surface of a discharge electrode of an ion generating device of the present invention, other than a surface in contact with a dielectric body, is coated with a protective layer made of a metal that is gold or a combination of gold and nickel. This allows the ion generating device to generate ions evenly and stably, and to have a longer life.

1 Claim, 12 Drawing Sheets

FOREIGN PATENT DOCUMENTS

| | | |
|---|---|---|
| JP | 2000-173744 | 6/2000 |
| JP | 2001-166569 A | 6/2001 |
| JP | 2001-313149 | 11/2001 |
| JP | 2002-237368 | 8/2002 |
| JP | 2003-036954 | 2/2003 |
| JP | 2003-249327 | 9/2003 |
| JP | 2003-327416 | 11/2003 |
| JP | 2004-69860 | 3/2004 |
| JP | 2005-050590 | 2/2005 |
| JP | 2006-340740 | 12/2006 |

* cited by examiner

FIG. 6 (a-1)
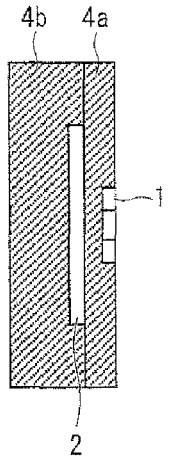
FIG. 6 (a-2)
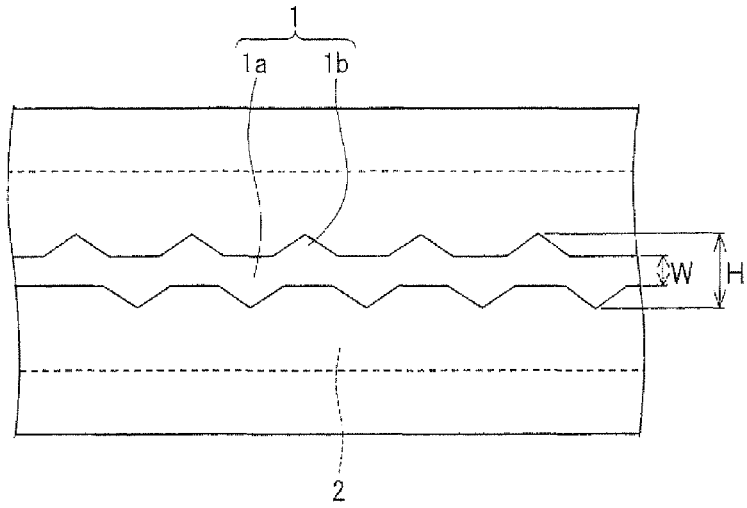
FIG. 6 (b-1)
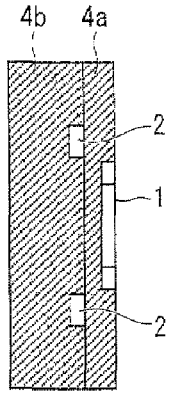
FIG. 6 (b-2)
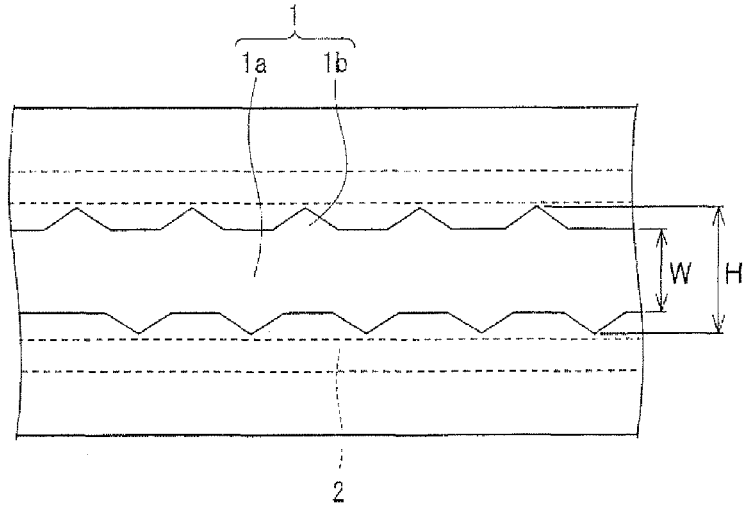

ION GENERATING DEVICE WITH A DISCHARGE ELECTRODE ON A DIELECTRIC BODY COATED BY A PROTECTIVE LAYER MADE OF METAL

This Nonprovisional application claims priority under 35 U.S.C. §119(a) on Patent Application No. 204791/2007 filed in Japan on Aug. 6, 2007, the entire contents of which are hereby incorporated by reference.

FIELD OF THE INVENTION

The present invention relates to: an ion generating device that is included in an image forming apparatus such as a copying machine, a printer, and a facsimile and that is used in an image forming process in which an electrostatic latent image formed on an image bearing member is developed by a toner and then transferred to and fixed on a printing medium; a method for producing the ion generating device; a charging device; and an image forming apparatus.

BACKGROUND OF THE INVENTION

Conventionally, in an image forming apparatus that employs an electrophotographic printing method, a charging device that employs a corona discharge system has been used in, for example, charging means for charging a photoreceptor that is an image bearing member for bearing an electrostatic latent image, transfer means for transferring a toner image formed on the photoreceptor to recording paper that is a transfer receiving material and a recording medium via a transfer belt that is a transfer receiving material and an intermediate transfer body, and separation means for separating the recording paper which electrostatically comes into contact with the photoreceptor or the like.

Patent Document 1 (Japanese Unexamined Patent Publication No. 11946/1994 (published on Jan. 21, 1994)) discloses such a charging device employing a corona charging system. This charging device includes: a shield case having an opening section which faces a charge receiving material such as a photoreceptor and a transfer belt; and a discharge electrode whose discharging surface has a line shape, a sawtooth shape, or a needle shape and which is provided in a tensioned state in the shield case. The charging device disclosed in Patent Document 1 is (a) a corotron that applies a high voltage to the discharge electrode so as to generate corona discharge, thereby uniformly charging a charge receiving material, or (b) a scorotron that applies a desired voltage to a grid electrode provided between a discharge electrode and a charge receiving material, thereby uniformly charging the charge receiving material.

FIG. 12 is a drawing explaining a charging mechanism in a charging device employing the corona discharge system. By applying a high voltage across a discharging electrode 71 with small curvature radius and a grid electrode 72, an uneven electric field is generated between the two electrodes. Consequently, local ionization occurs due to a high electric field in the vicinity of the discharging electrode 71, electrons are discharged toward the charge receiving material 11 (in a direction of an arrow D in FIG. 12) (discharge due to electron avalanche), and a toner 12 on the charge receiving material 11 is charged. The grid electrode 72 is used to control the amount of electrons moving toward the charge receiving material 11. Electrons are also discharged to the grid electrode 72.

The charging device employing the corona discharge system is used in a pre-transfer charging device for charging a toner image that has not been transferred yet to a transfer medium such as an intermediate transfer body and a recording paper. Examples of such a charging device are disclosed in Japanese Unexamined Patent Publication No. 274892/1998 (Tokukaihei 10-274892) (published on Oct. 13, 1998) (Patent Document 2) and Japanese Unexamined Patent Publication No. 69860/2004 (Tokukai 2004-69860) (published on Mar. 4, 2004) (Patent Document 3). According to techniques as disclosed in Patent Documents 2 and 3, even if a charge amount is not uniform in the toner image formed on an image bearing member, the charge amount of the toner image is uniform before the toner image is transferred. Therefore, it becomes possible to suppress a decrease in a transfer margin at the time of transferring a toner image, and also to stably transfer the toner image to a transfer medium.

However, the conventional charging device described above has a plurality of problems. The first problem concerns a space in which the charging device is provided. The charging device employing the corona discharging system requires not only the discharge electrode 71 but also the shield case, the grid electrode 72, and the like. Further, it is necessary to ensure a considerably large distance (e.g. 10 mm or so) between the discharge electrode 71 and the charge receiving material 11. As a result, a large space is necessary for providing the charging device. In an image forming apparatus, a photoreceptor, developing means for supplying a toner to an electrostatic latent image on the photoreceptor to form a toner image on the photoreceptor, first transfer means for transferring the toner image on the photoreceptor to a transfer belt, recording transfer means for transferring the toner image on the transfer belt to recording paper etc. are provided around the charging device. Consequently, a space for the charging device is small. Therefore, in the conventional charging device employing the corona discharge system, it is difficult to provide the charging device employing the corona discharge system that requires a comparatively large space.

The second problem concerns discharge products that are generated when the charging device charges the charge receiving material 11. As illustrated in FIG. 12, the charging device employing the corona discharge system generates a large amount of discharge products such as ozone ($O_3$) and nitrogen oxide (NOx). Specifically, due to an energy derived from discharge of electrons from the charging device, nitrogen molecules ($N_2$) in the air are separated into nitrogen atoms (N), and the nitrogen atoms bind to oxygen molecules ($O_2$) to form nitrogen oxides (nitrogen dioxide: $NO_2$). Similarly, oxygen molecules ($O_2$) in the air are separated into oxygen atoms (O), and the oxygen atoms bind to oxygen molecules ($O_2$) to form ozone ($O_3$). Generation of a large amount of ozone causes (i) ozone smell, (ii) a harmful influence on a human body, (iii) deterioration of members due to strong oxidation power, and the like. Further, when nitrogen oxide is generated, nitrogen oxide as ammonium salt (ammonium nitrate) adheres to the photoreceptor. This causes a defect in an image. Especially, usage of an organic photoconductor (OPC) as a photoreceptor tends to cause a defect in an image, for example, a white spot or an image deletion because of ozone, NOx or the like.

The third problem concerns a corona wind generated when the charging device charges the charge receiving material 11. The corona wind is generated from the discharging electrode 71 toward the charge receiving material 11 due to the flow of electrons caused by corona discharge. When the charging device employing the corona discharge system is used as a pre-transfer charging device, the corona wind disturbs a toner image formed on the charge receiving material 11.

As a charging device capable of reducing generation of discharge products, there is proposed a charging device employing a contact electrification system in which a conductive roller or a conductive brush touches a charge receiving material in order to charge the charge receiving material. However, since the conductive roller or the conductive brush touches the charge receiving material in order to charge it in the charging device employing the contact electrification system, it is difficult to charge the charge receiving material without disturbing a toner image formed on the charge receiving material. Therefore, the charging device employing the contact electrification system is not appropriate for a pre-transfer charging device.

Japanese Unexamined Patent Publication No. 160711/1996 (Tokukaihei 8-160711) (published on Jun. 21, 1996) (Patent Document 4) discloses a charging device employing a corona discharge system, capable of reducing generation of discharge products. The charging device disclosed in Patent Document 4 includes: a plurality of discharge electrodes arranged at a substantially equal pitch in a predetermined axial direction; a high voltage power source for applying, to the discharge electrodes, a voltage equal to or higher than a predetermined voltage for starting discharge; a resistor provided between an output electrode of the high voltage power source and the discharge electrodes; a grid electrode provided in the vicinity of the discharge electrodes and between the discharge electrodes and the charge receiving material; and a grid power source for applying a predetermined grid voltage to the grid electrode. A gap between the discharge electrodes and the grid electrode is set to be 4 mm or less. Thus, by reducing the gap between the discharge electrodes and the grid electrode, it is possible to reduce a discharge current, thereby reducing generation of the discharge products.

However, the charging device disclosed in Patent Document 4 cannot sufficiently reduce generation of discharge products, and approximately 0.3 ppm of ozone is still generated. Further, since the charging device disclosed in Patent Document 4 has a small gap between the discharge electrodes and the grid electrode, foreign matters such as discharge products, a toner, and paper powder derived from recording paper that is a transfer receiving material tend to attach to the discharge electrodes. Since a discharge surface of the discharge electrode employing the corona discharge system has a complex shape such as a needle shape, the foreign matters attached to the discharge electrode are difficult to be removed (cleaned). Further, a tip of the discharge electrode is likely to be abraded/deteriorated due to discharge energy, which causes the discharge electrode to discharge unstably. Moreover, because a gap between the discharge electrodes and the charge receiving material is narrow, non-uniformity in charging easily occurs in a long direction (axial direction in which a plurality of discharge electrodes are aligned) due to the pitch of a plurality of the discharge electrodes. Here, a shorter pitch of the discharge electrodes may improve the non-uniformity in charging. However, this increases the number of the discharge electrodes, which increases production cost.

In view of such problems, Japanese Unexamined Patent Publication No. 173744/2000 (Tokukai 2000-173744) (published on Jun. 23, 2000) (Patent Document 5), Japanese Unexamined Patent Publication No. 249327/2003 (Tokukai 2003-249327) (published on Sep. 5, 2003) (Patent Document 6), Japanese Unexamined Patent Publication No. 327416/2003 (Tokukai 2003-327416) (published on Nov. 19, 2003) (Patent Document 7), Japanese Unexamined Patent Publication No. 50590/2005 (Tokukai 2005-50590) (published on Feb. 24, 2005) (Patent Document 8), Japanese Unexamined Patent Publication No. 36954/2003 (Tokukai 2003-36954) (published on Feb. 7, 2003) (Patent Document 9), and Japanese Unexamined Patent Publication No. 340740/2006 (Tokukai. 2006-340740) (published on Dec. 21, 2006) (Patent Document 10) disclose ion generating devices and charging devices each employing a creeping discharge system. Such ion generating devices and charging devices include an ion generating device (creeping discharge device) that consists of a discharge electrode and an inductive electrode provided to face each other with a dielectric material therebetween and that applies a pulse waveform voltage across the two electrodes to generate ions. In such ion generating devices and charging devices, a charge receiving material is provided opposite to the inductive electrode to face the discharge electrode, and is charged with generated ions.

SUMMARY OF THE INVENTION

The charging device employing the creeping discharge system does not require a shield case, a grid electrode, and the like included in a charging device employing the corona discharge system. Consequently, a space for providing the charging device may be set to be comparatively small. Further, the charging device employing the creeping discharge system has a plate-shaped discharge electrode and a flat discharge surface. Therefore, it is easy to clean off foreign matters attached to the discharge electrode. Further, in the charging device employing the creeping discharge system, discharge occurs between the discharge electrode and the inductive electrode, and therefore a corona wind does not occur. Consequently, it is possible to prevent disturbance of a toner image on a charge receiving material due to the corona wind.

However, in the conventional charging device employing the creeping discharge system, a protective layer for covering the discharge electrode is formed through screen printing with use of a highly viscous ceramic paste material made of alumina. Consequently, defects such as uneven thickness, pinholes, voids, and cracks tend to appear in the protective layer, which is likely to cause uneven discharge.

Patent Document 6 discloses a charging device employing the creeping discharge system, in which a discharge electrode is formed by attaching stainless or copper to a dielectric body made of ceramic, mica, resin or etc. and by etching stainless or copper. In a case where mica or resin is used as a dielectric body, the dielectric body absorbs moisture under high temperature and high moisture conditions and insulating resistance changes, which causes uneven discharge. Further, in a case where a discharge electrode is attached to a dielectric body via an adhesive layer, the adhesive layer deteriorates due to discharge energy and the discharge electrode is partially loosened or peeled, which causes uneven discharge.

Further, Patent Document 9 discloses forming a discharge electrode mainly made of tungsten. A protective layer made of a ceramic material (alumina) is formed on the discharge electrode, and consequently discharge tends to be uneven.

The present invention was made in view of the foregoing problems. An object of the present invention is to provide an ion generating device with a long life (long duration) capable of evenly and stably generating ions, a method for producing the ion generating device, a charging device, and an image forming apparatus. Further, another object of the present invention is to provide an ion generating device without pinholes, cracks, and voids, thereby increasing uniformity in discharge and uniformity in image quality.

In order to solve the foregoing problems, the ion generating device of an embodiment of the present invention is an ion generating device, including: a discharge electrode on a dielectric body; and an inductive electrode on a plane of the dielectric body that is opposite to a plane where the discharge electrode is formed, the ion generating device generating ions through creeping discharge caused by applying a voltage across the discharge electrode and the inductive electrode so that a potential difference exists between the discharge electrode and the inductive electrode, a surface of the discharge electrode other than a surface in contact with the dielectric body being coated with a protective layer made of a metal that is gold or a combination of gold and nickel.

In a conventional technique, a protective layer is made of a ceramic material used for a dielectric body through screen printing. However, such protective layer is likely to have defects such as uneven thickness, pinholes, voids, cracks etc., resulting in non-uniformity in discharge. In a case where the protective layer is not provided, a discharge electrode may be abraded or oxidized due to discharge energy depending on a material of the discharge electrode, resulting in an extremely shorter life than a case where the protective layer is provided. Therefore, the protective layer is made of a metal as describe above. Thus, the protective layer can be formed through plating and consequently can be made thinner and more even than a conventional protective layer, and can be free from pinholes, cracks, and voids. As a result, the ion generating device with the above arrangement can generate ions evenly and stably and have a longer life.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*b*) is a cross sectional drawing illustrating an ion generating device provided with a protective layer made of gold and nickel.

FIG. 3(*b*) is a side drawing illustrating an arrangement of an example ion generating device of the present invention.

FIG. 5(*b*) is a drawing illustrating a state where a discharge electrode of an ion generating device is embedded in a dielectric body.

FIG. 6(*a*-1) is a cross sectional drawing illustrating an ion generating device in which a discharge electrode has a narrow base section and an inductive electrode has a plane-shape.

FIG. 6(*a*-2) is a plan drawing illustrating the ion generating device in FIG. 6(*a*-1).

FIG. 6(*b*-1) is a cross sectional drawing illustrating an ion generating device in which a discharge electrode has a wide base section and an inductive electrode has a U-shape.

FIG. 6(*b*-2) is a plan drawing illustrating the ion generating device in FIG. 6(*b*-1).

FIG. 7(*b*) is an elevation drawing illustrating the measurement device for measuring discharge distribution of an ion generating device.

FIG. 10(*b*) is a plan drawing illustrating oxidization of an ion generating device in which a discharge electrode has a wide base section and an inductive electrode has a U-shape.

FIG. 11(*b*) is a cross sectional drawing illustrating an ion generating device provided with a protective layer made of LTCC.

FIG. 11(*c*) is a cross sectional drawing illustrating an ion generating device without a protective layer.

DESCRIPTION OF THE EMBODIMENTS

Figure 1:
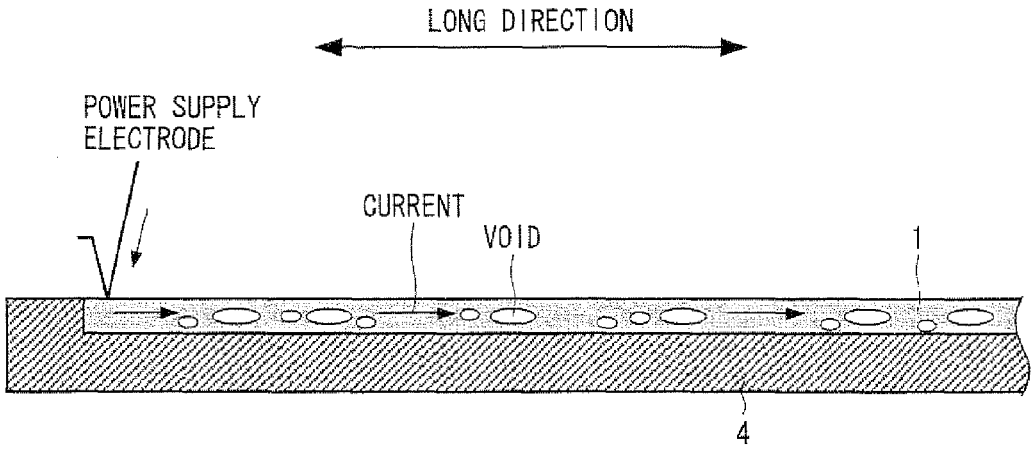
FIG. 1(*a*) is a cross sectional drawing illustrating an ion generating device without a protective layer.
Figure 1:
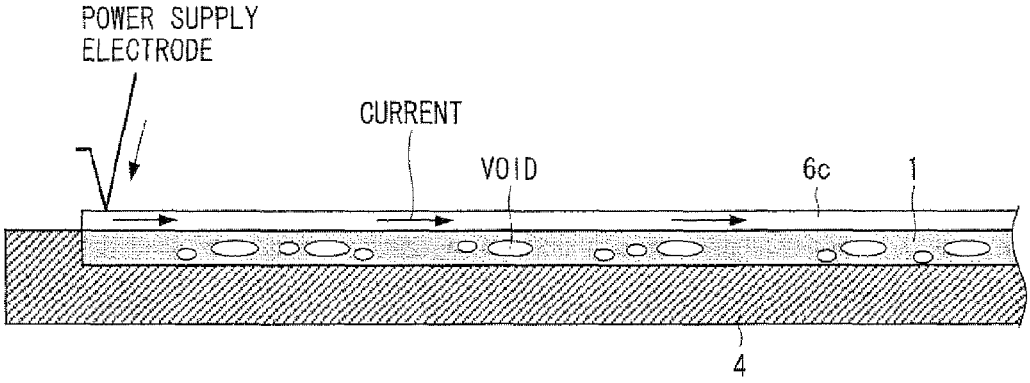

With reference to FIGS. 1(*a*) to 4, the following specifically explains an embodiment of an ion generating device of the present invention, a charging device of the present invention, and an image forming apparatus of the present invention including the charging device. The following embodiment is a concrete example of the present invention, and the technical scope of the present invention is not limited to this example.

Figure 2:
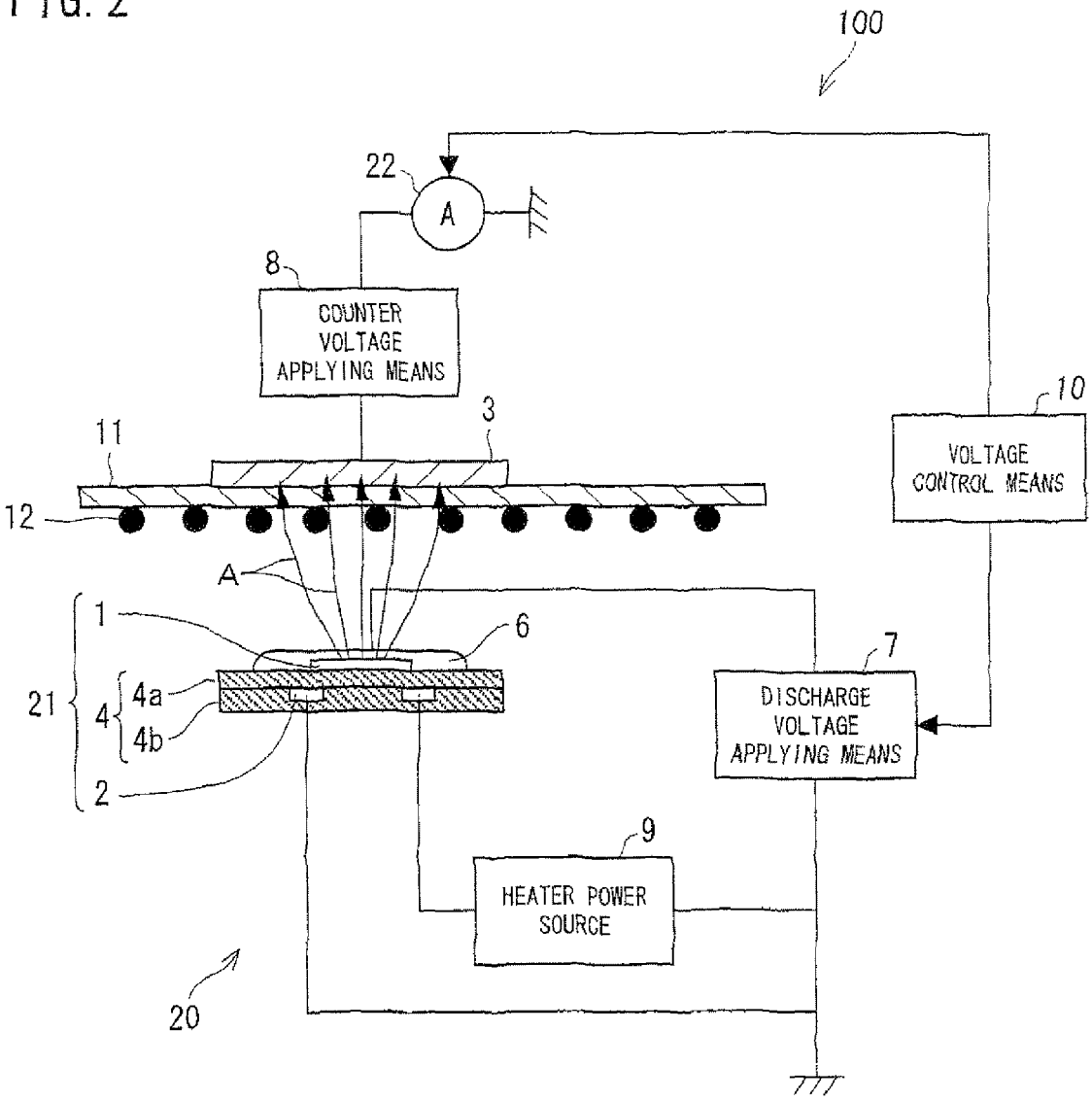
FIG. 2 is a drawing illustrating an example arrangement of a charging device of the present invention, including an example ion generating device of the present invention.
Figure 3A:
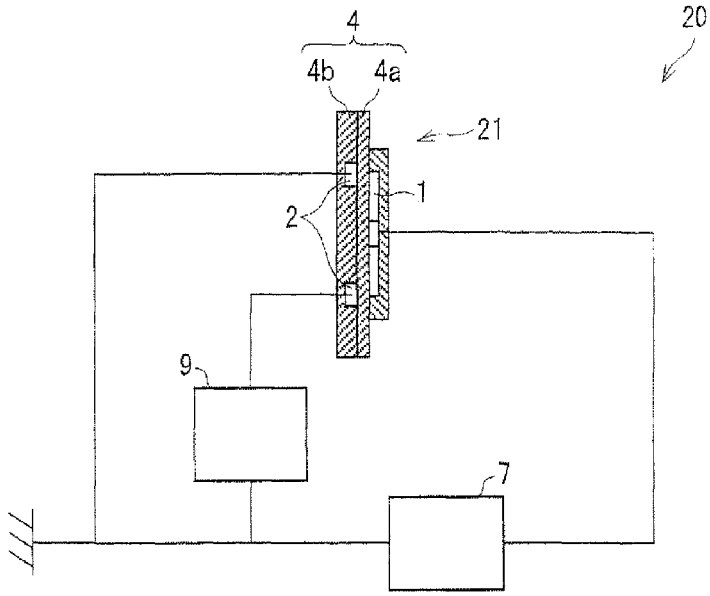
FIG. 3(*a*) is a drawing illustrating an arrangement of an example ion generating means including an example ion generating device of the present invention.
Figure 3B:
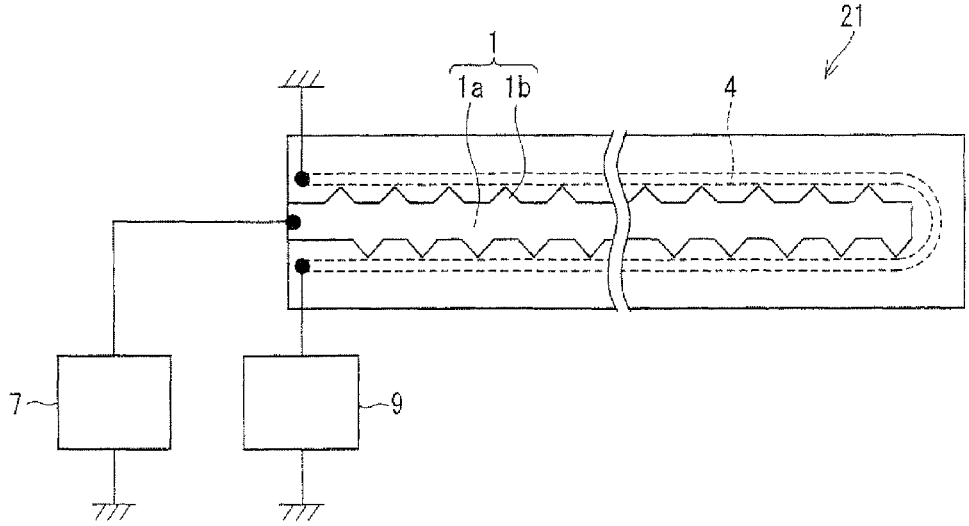

First, an explanation is made as to an ion generating device of the present embodiment and a charging device of the present embodiment. FIG. 2 is a drawing illustrating an arrangement of a charging device 100 of an embodiment of the present invention. FIGS. 3(*a*) and 3(*b*) are drawings each illustrating ion generating means 20 including an ion generating device 21. FIG. 3(*a*) is a side drawing and FIG. 3(*b*) is an elevation drawing.

The charging device 100 charges a charge receiving material 11 to be charged. When a toner image is formed on the charge receiving material 11, the charging device 100 charges a toner 12 on the charge receiving material 11. As illustrated in FIG. 2, the charging device 100 includes the ion generating means 20, a counter electrode 3, and voltage control means (control circuit) 10.

The ion generating means 20 includes: the ion generating device 21 including a dielectric body 4, a discharge electrode 1, an inductive electrode 2, and a protective layer (coating layer) 6; and discharge voltage applying means (high voltage source) 7 for applying a voltage on the discharge electrode 1 and/or the inductive electrode 2. The ion generating means 20 generates ions by discharge that is generated in accordance with an electric potential difference between the discharge electrode 1 and the inductive electrode 2 (corona discharge that is produced in the vicinity of the discharge electrode 1 in a direction along a surface of the dielectric body 4).

The dielectric body 4 is arranged as a flat plate that is made by bonding an upper dielectric body 4*a* and a lower dielectric body 4*b* that are substantially rectangular. When the dielectric body 4 is made of an organic material, a preferable material of the dielectric body 4 is a material that is excellent in oxidation resistance. For example, resin such as polyimide or glass epoxy may be used as such a material. When an inorganic material is selected as a material of the dielectric body 4, ceramics such as mica, alumina with high purity, crystalline glass, forsterite, steatite, and low temperature co-fired ceramic (LTCC) that is a composition material of glass and alumina may be used as the material. In terms of corrosion resistance, an inorganic material is more preferable as the material of the dielectric body 4. Further, in terms of formability, easiness in electrode formation later explained, low moisture resistance, or the like, ceramic is preferably used in formation of the dielectric body 4. Moreover, it is desirable that an insulation resistance between the discharge electrode 1 and the inductive electrode 2 is uniform. Accordingly, the less a density inside the material of the dielectric body 4 varies and the more uniform an insulation ratio of the dielectric body 4 becomes, the more preferable the dielectric body 4 becomes.

The discharge electrode 1 is formed on the surface of the upper dielectric body 4*a* in such a manner as to be integrated with the dielectric body 4*a*. A material of the discharge electrode 1 is not specifically limited as long as the material is electrically conductive like, for example, gold, tungsten, silver, silver palladium or stainless steel. However, the material must not cause deformation such as meltdown or scattering due to discharge. In a case where the discharge electrode 1 is provided in such a manner as to protrude from the surface of the upper dielectric body 4*a*, it is preferable that the discharge electrode 1 has an even thickness. Further, in a case where the discharge electrode 1 is provided inside the upper dielectric body 4*a* (in a case where surfaces of the discharge electrode 1 other than a surface coated with the protective layer 6 are embedded in the dielectric body 4), it is preferable that the discharge electrode 1 is provided in such a manner that the depth of the discharge electrode 1 from the surface of the upper dielectric body 4*a* is uniform. In the present embodiment, the discharge electrode 1 is made of silver palladium, gold, or tungsten. The shape of the discharge electrode 1 may be any shape as long as the discharge electrode 1 extends in a direction perpendicular to a direction in which the charge receiving material 11 moves between the ion generating device 21 and the counter electrode 3 and the discharge electrode 1 extends along the surface of the charge receiving material 11. However, in a case where the discharge electrode 1 has a shape that is likely to cause electric field concentration with the inductive electrode 2, such shape as a saw-tooth shape with plural edges on its periphery as illustrated in FIG. 3(*b*), even when a low voltage is applied across the discharge electrode 1 and the inductive electrode 2, discharge can occur between the electrodes. Therefore, such shape is desirable.

The inductive electrode 2 is formed inside the dielectric body 4 (between the upper dielectric body 4*a* and the lower dielectric body 4*b*) and provided so as to be opposite to the discharge electrode 1 with the upper dielectric body 4*a* therebetween. This is because it is preferable that the insulation resistance between the discharge electrode 1 and the inductive electrode 2 is uniform and the discharge electrode 1 and the inductive electrode 2 are provided in parallel to each other. This arrangement makes it possible to have a constant distance between the discharge electrode 1 and the inductive electrode 2 (hereinafter, referred to as a distance between electrodes). Accordingly, a discharge state between the discharge electrode 1 and the inductive electrode 2 becomes stable and ions can be generated appropriately.

The inductive electrode 2 may be provided on the back side of the dielectric body 4 as one layer (the side opposite to a side where the discharge electrode 1 is provided). In this arrangement, the discharge electrode 1 and the inductive electrode 2 are provided to sandwich the dielectric body 4 that is one layer. This case requires ensuring a creeping distance sufficient with respect to a voltage applied on the discharge electrode 1 or coating the discharge electrode 1 or the inductive electrode 2 with a later-mentioned insulating coating layer 6 in order that a current flowing in the discharge electrode 1 in response to application of a voltage does not flow into the inductive electrode 2 via the dielectric body 4.

In the same manner as the discharge electrode 1, a material of the inductive electrode 2 is not specifically limited as long as the material is electrically conductive like, for example, gold, tungsten, silver, silver palladium, or stainless steel. The present embodiment employs silver palladium, gold, and tungsten as the materials of the inductive electrode 2. In a case where the peripheral shape of the discharge electrode 1 is designed to have a saw-tooth shape with plural edges as illustrated in FIG. 3(*b*), the shape of the discharge electrode 1 viewed from the top is designed to have a U-shape.

The discharge voltage applying means 7 includes a high alternating voltage source for applying a voltage to the discharge electrode 1 and/or the inductive electrode 2 and a voltage applying circuit that serves as a circuit via which a current flows in response to application of a voltage by the high alternating voltage source. For example, in a case where both of the discharge electrode 1 and the inductive electrode 2 are connected with the voltage applying circuit, the high alternating voltage source applies a voltage across both of the discharge electrode 1 and the inductive electrode 2. Further, in a case where the inductive electrode 2 is grounded to have a ground potential and the discharge electrode 1 is connected with the voltage applying circuit, the high alternating voltage source applies a voltage only on the discharge electrode 1. Further, in a case where the discharge electrode 1 is grounded to have a ground potential and the inductive electrode 2 is connected with the voltage applying circuit, the high alternating voltage source applies a voltage only on the inductive electrode 2. In the present embodiment, the discharge voltage applying means 7 applies a voltage only on the discharge electrode 1. When the discharge voltage applying means 7 applies a voltage on the discharge electrode 1 while the inductive electrode 2 is grounded, creeping discharge occurs in the vicinity of the discharge electrode 1 in accordance with a potential difference between the discharge electrode 1 and the inductive electrode 2. The creeping discharge ionizes the air around the discharge electrode 1, resulting in generation of negative ions.

It is desirable that the ion generating means 20 is provided with heating means for heating the dielectric body 4. The inductive electrode 2 may double as the heating means. In the present embodiment, the inductive electrode 2 is designed to have a U-shape viewed from the top, and one end of the inductive electrode 2 is connected to a heater power source 9 and the other end is connected to ground. The heater power source 9 applies a predetermined voltage (e.g. 10V) to the inductive electrode 2 so that the inductive electrode 2 generates heat due to Joule heat. By causing the inductive electrode 2 to generate heat, a temperature of the dielectric layer 4 rises (to approximately 60° C. for example). This can suppress moisture absorption of the dielectric body 4 and makes it possible to stably generate ions in a high humidity environment. When the dielectric body 4 is made of ceramic, the dielectric body 4 itself does not absorb moisture. However, when dew condensation occurs on a surface of the dielectric body 4, a discharge characteristic deteriorates. Therefore, it is effective to prevent dew condensation or vanish dewdrops by causing the heater to generate heat.

The protective layer 6 is formed on the dielectric body 4 in such a manner as to cover the discharge electrode 1. In the present embodiment, the protective layer 6 is made of a metal (e.g. gold, combination of gold and nickel). Since the protective layer 6 is formed in such a manner as to cover the discharge electrode 1, it is possible to prevent abrasion/deterioration of the discharge electrode 1 due to discharge energy derived from application of a voltage on the discharge electrode 1. The present invention may be arranged so that the discharge electrode 1 is directly exposed to the atmosphere without providing the protective layer 6.

The following explains a method for producing the ion generating device 21 in the present embodiment. However, the method is not limited to the following method or numeral values. First, green sheets made of LTCC of 0.2 mm and 0.7 mm in thickness, respectively, are cut into sheets of 400 mm in width and 400 mm in length and thus the upper dielectric body 4*a* of 0.2 mm in thickness and the lower dielectric body 4*b* of 0.7 mm in thickness are formed. Next, the discharge electrode 1 mainly made of silver palladium is formed on the upper surface of the upper dielectric body 4*a* through screen printing so that the discharge electrode 1 is formed integrally with the upper dielectric body 4*a*. Further, the inductive electrode 2 mainly made of silver palladium is formed on the upper surface of the lower dielectric body 4*b* through screen printing so that the inductive electrode 2 is formed integrally with the lower dielectric body 4*b*. Note that the final size of the ion generating device 21 is 8 mm×356 mm and therefore a plurality of the ion generating devices 21 are formed in one green sheet (in the present embodiment, 14 ion generating devices 21 are obtained from one green sheet).

Next, a lower surface of the upper dielectric body 4*a* (surface where the discharge electrode 1 is not formed) and an upper surface of the lower dielectric body 4*b* (surface where the inductive electrode 2 is formed) are brought together, and then pressed and attached to each other using a press jig (Warm Isostatic Press: WIP). Then, the laminated green sheets are cut into sheets with a predetermined size by a mold corresponding to outlines of a plurality of the ion generating devices. Then, the cut sheets are put into a furnace and baked in a non-oxidized atmosphere at a temperature ranging from 800° C. to 900° C.

Thus, the ion generating device 21 in which the discharge electrode 1, the dielectric body 4, and the inductive electrode 2 are integrated with one another is formed.

Thereafter, the discharge electrode 1 is connected with the discharge voltage applying means 7 and the inductive electrode 2 is connected with the heater power source 9 so that the ion generating means 20 is produced.

The counter electrode 3 is provided in such a manner as to be opposite to the discharge electrode 1 of the ion generating means 20, and controls a flow of ions generated by the ion generating means 20. The material for the counter electrode 3 is not particularly limited as long as it has conductivity. Examples of the material include tungsten, silver, and stainless steel. In the present embodiment, the counter electrode 3 is made of stainless steel, and has a plate shape. The counter electrode 3 is connected with counter voltage applying means 8. The counter voltage applying means 8 includes a counter electrode power source for applying a voltage on the counter electrode 3. The counter electrode 3 is connected with a ground via the counter electrode power source, and a predetermined voltage is applied on the counter electrode 3 from the counter electrode power source. The counter voltage applying means 8 applies, on the counter electrode 3, a voltage whose polarity is opposite to that of generated ions. By arranging the counter electrode 3 in this way, ions generated in the vicinity of the discharge electrode 1 of the ion generating means 20 flow toward the counter electrode 3. The counter voltage applying means 8 is provided so that ions generated in the vicinity of the discharge electrode 1 are more likely to flow toward the charge receiving material. The counter voltage applying means 8 is not necessarily required and may be omitted.

When the charge receiving material 11 is charged in the charging device 100, the charge receiving material 11 is positioned between the discharge electrode 1 and the counter electrode 3 of the ion generating means 20 in such a manner as to closely touch the counter electrode 3 and to face the discharge electrode 1. When the discharge voltage applying means 7 applies a voltage on the discharge electrode 1 while positioning the charge receiving material 11 in this way, discharge occurs between the discharge electrode 1 and the inductive electrode 2, and creeping discharge occurs in the vicinity of the discharge electrode 1. Since discharge occurs between the discharge electrode 1 and the inductive electrode 2 in this way, it is possible to prevent a corona wind in the conventional charging device employing the corona discharge system.

Ions generated by ionizing the air around the discharge electrode 1 through creeping discharge flow toward the counter electrode 3 (in a direction of an arrow A in FIG. 2) and charges the charge receiving material 11. Since ions generated by the ion generating means 20 flow toward the counter electrode 3 and charges the charge receiving material 11, it is possible to prevent the ions from remaining in the vicinity of the discharge electrode 1. Therefore, it is possible to prevent the amount of ions used to charge the charge receiving material 11 from dropping with respect to the amount of ions generated by the ion generating means 20, thereby increasing usage efficiency of ions. Therefore, as detailed later, the ion generating means 20 can generate ions whose amount is enough to charge the charge receiving material 11, while applying a comparatively small voltage on the discharge electrode 1. Consequently, it is possible to reduce the generation amount of discharge products such as ozone.

The voltage control means 10 includes a counter electrode amperemeter 22 for measuring the amount of a current flowing in the counter electrode 3. The counter electrode amperemeter 22 is connected with the counter electrode 3. As detailed later, the voltage control means 10 feedback-controls the amount of a voltage applied by the discharge voltage applying means 7 and/or the counter electrode applying means 8 so that the amount of a current flowing in the counter electrode 3 is not less than the amount of a current flowing in the counter electrode 3 when the charge amount of the charge receiving material 11 reaches a saturation amount. The amount of ions generated by the ion generating means 20 varies according to attachment of foreign matters to the discharge electrode 1 and surrounding conditions under which ions are generated. Further, the ratio of generated ions reaching the charge receiving material 11 varies according to a change in a flow of a wind in the vicinities of the discharge electrode 1 and the charge receiving material 11. Consequently, there is a case where the charge amount of the charge receiving material 11 is not always constant even when a voltage applied on the discharge electrode 1 is kept to be constant. For that reason, in consideration of relationship between the charge amount of the charge receiving material 11 and the amount of a current flowing in the counter electrode 3, the amount of a current flowing in the counter electrode 3 is regarded as an index for controlling the charge amount of the charge receiving material 11, and the amount of a voltage applied on the discharge electrode 1 is feedbackcontrolled in accordance with the index. Thus, it is possible to apply the most appropriate amount of ions to the charge receiving material 11.

Figure 4:
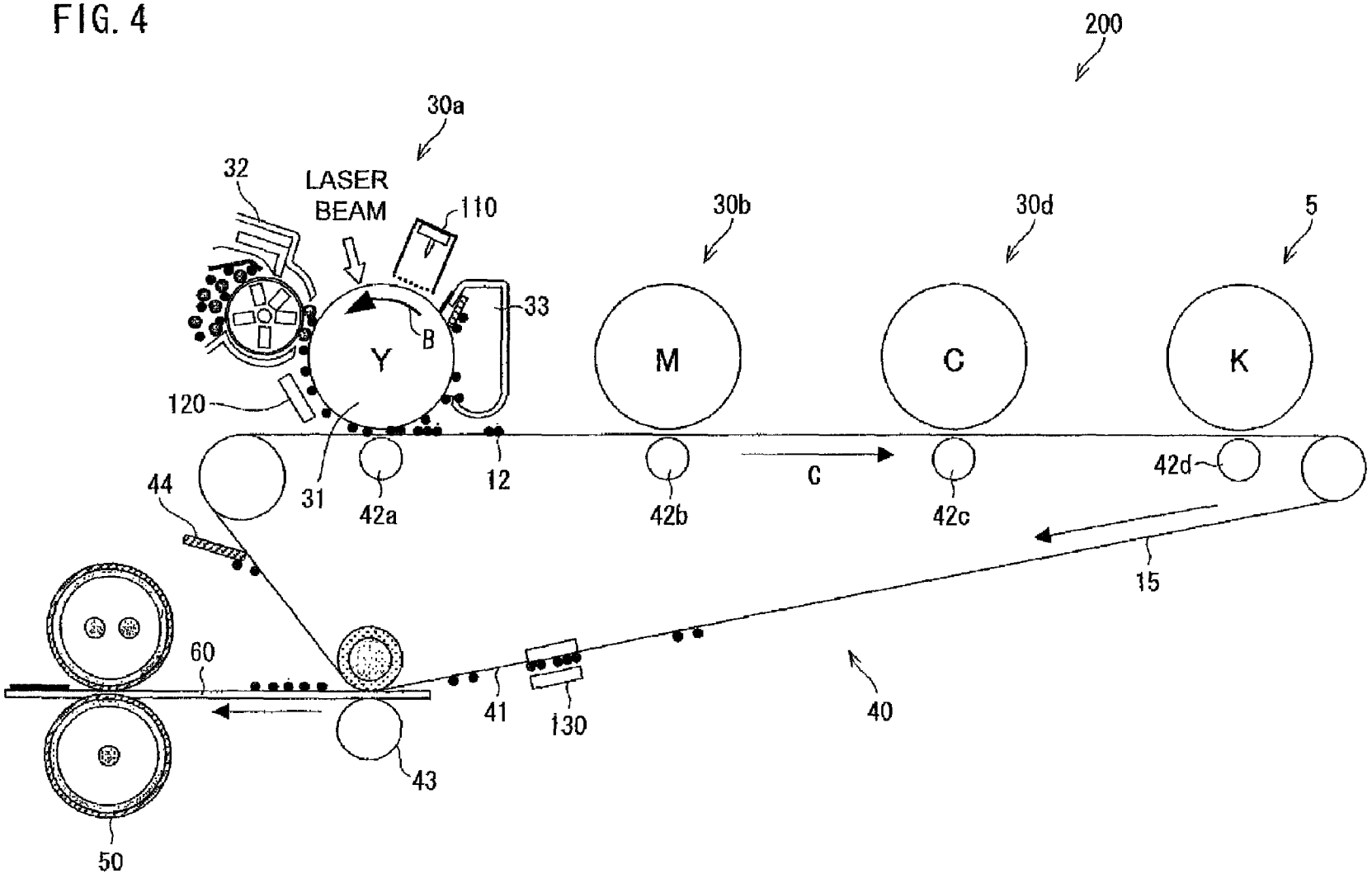
FIG. 4 is an explanatory drawing illustrating an arrangement of a main part of an image forming apparatus of the present invention.

The following explains an image forming apparatus including the charging device 100. FIG. 4 is a cross sectional view schematically illustrating an arrangement of an image forming apparatus 200 according to the present embodiment. The image forming apparatus 200 is a tandem type printer employing an intermediate transfer system, and can form a full color image.

As illustrated in FIG. 4, the image forming apparatus 200 includes visible image forming means 30*a* to 30*d*, transfer means 40, and fixing means 50.

Four visible image forming means 30*a* to 30*d* are provided so as to correspond to image information of cyan (C), magenta (M), yellow (Y), and black (B), respectively, included in color image information. The four visible image forming means 30*a* to 30*d* have the same arrangement except for the colors of toners used in them, and use toners for cyan (C), magenta (M), yellow (Y), and black (B), respectively. The following explains only the visible image forming means 30*a* and explanations of other visible image forming means 30*b* to 30*d* are omitted here. Accordingly, FIG. 4 illustrates only members of the visible image forming means 30*a*. However, other visible image forming means 30*b* to 30*d* have the same members as those of the visible image forming means 30*a*. The visible image forming means 30*a* includes a photoreceptor (electrostatic latent image bearing member) 31, charging means 110 before formation of a latent image (first charging means), developing means 32, charging means 120 before intermediate transfer (second charging means), and photoreceptor cleaning means 33.

The photoreceptor 31 is an image bearing member for bearing an electrostatic latent image corresponding to image information from the outside. The photoreceptor 31 is supported by driving means (not shown) in such a manner as to be rotatable around an axis, and includes a cylindrical conductive base material (not shown) and a photosensitive layer formed around the surface of the conductive base material. The photoreceptor 31 is controlled to rotate at a predetermined peripheral velocity (e.g. 167-225 mm/s) at a time of image formation. The electrostatic latent image formed on the photoreceptor 31 is formed by laser writing means (not shown) irradiating (exposing) laser light in accordance with the image information from the outside. The photoreceptor 31 may be a photoreceptor commonly used in this technical field. An example of the photoreceptor 31 is a photoreceptor drum including an aluminum tube that is a conductive base material and an organic photosensitive layer formed on the surface of the aluminum tube. The organic photosensitive layer is made by laminating a charge generation layer including a charge generation substance and a charge transport layer including a charge transport substance. The organic photosensitive layer may be one layer including the charge generation substance and the charge transport substance.

The first charging means 110 before formation of a latent image charges the surface of the photoreceptor 31 with a predetermined potential before the laser writing means irradiates laser light to the photoreceptor 31. In the present embodiment, the aforementioned charging device 100 is used as the first charging means 110 before formation of a latent image, and charges the photoreceptor 31 with use of emitted ions, which will be detailed later.

The developing means 32 supplies a toner to the electrostatic latent image formed on the photoreceptor 31, and makes the electrostatic latent image visible to form a toner image. The developing means 32 includes a developing roller for supplying a toner to the photoreceptor 31, a layer thickness regulating member for regulating the thickness of a toner layer formed on the outer surface of the developing roller, a stirring and supplying roller for supplying the toner to the developing roller, etc.

The second charging means 120 before intermediate transfer charges the toner image formed on the surface of the photoreceptor 31 before the toner image is transferred. In the present embodiment, the aforementioned charging device 100 is used as the second charging means 120 before intermediate transfer, and charges the toner image with use of emitted ions, which will be detailed later.

The photoreceptor cleaning means 33 removes and collects, from the surface of the photoreceptor 31, a residual toner that has not been transferred from the photoreceptor 31 to a transfer belt 41 in a transfer operation.

Around the photoreceptor 31, the first charging means 110 before formation of a latent image, the laser writing means, the developing means 32, the second charging means 120 before intermediate transfer, and the photoreceptor cleaning means 33 are provided in this order from an upstream side in a rotation direction of the photoreceptor 31 (in a direction of an arrow B in FIG. 4). The four visible image forming means 30*a* to 30*d* corresponding to respective colors are provided along the transfer belt 41.

The transfer means 40 causes toner images of respective colors developed and formed on the photoreceptor 31 to be overlapped and transferred onto the transfer belt 41, and causes the toner image transferred onto the transfer belt 41 to be retransferred onto recording paper 60 that is a recording medium. The transfer means 40 includes the transfer belt 41, four intermediate transfer means 42*a* to 42*d* provided in the vicinity of the transfer belt 41, charging means 130 before transferring a record, record transfer means 43, and transfer cleaning means 44.

The transfer belt 41 is an intermediate transfer member onto which toner images of respective colors visualized by the visible image forming means 30*a* to 30*d* are overlapped and transferred. Specifically, the intermediate transfer belt 41 is a belt that has no end, and is suspended in a tensioned state by a pair of driving rollers and an idle roller. At the time of forming an image, the intermediate transfer belt 41 is subjected to conveyance driving under control at a predetermined peripheral velocity (e.g. 167 mm/s to 225 mm/s).

The visible image forming means 30*a* to 30*d* are provided with the intermediate transfer means 42*a* to 42*d*, respectively. The toner image is transferred to the transfer belt 41 by applying, to the intermediate transfer means 42*a* to 42*d*, a bias voltage whose polarity is opposite to that of the toner image formed on a surface of the photoreceptor 31. Each of the intermediate transfer means 42*a* to 42*d* includes an intermediate transfer roller that is driven to rotate around an axis, and the intermediate transfer roller is positioned so as to face the photoreceptor 31 via the transfer belt 41.

The third charging means 130 before transferring a record re-charges the toner image that has been overlapped and transferred onto the transfer belt 41. In the present embodiment, the aforementioned charging device 100 is used as the third charging means 130. The third charging means 130 emits ions so as to charge the toner image, which is explained later in detail.

The record transfer means 43 re-transfers, to the recording paper 60, the toner image which has been transferred to the transfer belt 41. The record transfer means 43 includes two record transfer rollers each being driven to rotate around an axis, and the two record transfer rollers sandwich the transfer belt 41. The recording paper 60 having fed from paper feeding means (not shown) onto the transfer belt 41 passes through a pressure area of the two recording transfer rollers, so that the toner image is transferred onto the recording paper 60. The transfer cleaning means 44 cleans the surface of the transfer belt 41 from which the toner image has been transferred. Around the transfer belt 41, the intermediate transfer means 42*a* to 42*d*, the third charging means 130 before transferring a record, the record transfer means 43, and the transfer cleaning means 44 are provided in this order from an upstream side in a rotation direction of the transfer belt 41 (in a direction of an arrow C in FIG. 4.

The record transfer means 43 re-transfers, to the recording paper 60, the toner image which has been transferred to the transfer belt 41. The record transfer means 43 includes two record transfer rollers each being driven to rotate around an axis, and the two record transfer rollers sandwich the transfer belt 41. The recording paper 60 having fed from paper feeding means (not shown) onto the transfer belt 41 passes through a pressure area of the two recording transfer rollers, so that the toner image is transferred onto the recording paper 60. The transfer cleaning means 44 cleans the surface of the transfer belt 41 from which the toner image has been transferred. Around the transfer belt 41, the intermediate transfer means 42*a* to 42*d*, the charging means 130 before transferring a record, the record transfer means 43, and the transfer cleaning means 44 are provided in this order from an upstream side in a rotation direction of the transfer belt 41 (in a direction of an arrow C in FIG. 4.

The fixing means 50 fixes, to the recording paper 60, the toner image having been transferred onto the recording paper 60. The fixing means 50 is provided in a downstream side of the record transfer means 43 in a carrying direction of the recording paper 60. The fixing means 50 includes a heat roller and a pressure roller that are driven to rotate around their axes. A heat source for heating the surface of the heat roller up to a fixing temperature is provided inside the heat roller. A pressure member for pressing the pressure roller to the heat roller with a predetermined pressure is provided at both ends of the pressure roller. The fixing means 50 causes the recording paper 60 on which the toner image has been transferred to pass through a pressure area between the heat roller and the pressure roller and causes the toner image to be fixed on the recording paper 60 by the heat roller heating and fusing the toner image and by the pressure roller anchoring the toner image to the recording paper 60. The recording paper 60 on which the recording image is formed in this way is output to paper output means (not shown).

Here, the image forming apparatus 200 includes the first charging means 110 before formation of a latent image, the second charging means 120 before intermediate transfer, and the third charging means 130 before transferring a record, each of which is the aforementioned charging device 100. In the case of the first charging means 110, a charge receiving material that is an object to be charged is the photoreceptor 31, and the discharge electrode 1 of the ion generating means 20 is provided to face the photoreceptor 31. In the case of the first charging means 110, the photoreceptor 31 doubles as a counter electrode. In the case of the charging means 110, ions generated by the ion generating means 20 flow toward the photoreceptor 31 that doubles as the counter electrode, and charge the surface of the photoreceptor 31 rotating around an axis.

In the case of the second charging means 120, a charge receiving material that is an object to be charged is a toner image formed on the photoreceptor 31, and the discharge electrode 1 of the ion generating means 20 is provided to face the photoreceptor 31. Further, in the case of the second charging means 120, the photoreceptor 31 doubles as a counter electrode. In the case of the second charging means 120, ions generated by the ion generating means 20 flow toward the photoreceptor 31 that doubles as the counter electrode, and charge a toner image formed on the photoreceptor 31 rotating around an axis.

In the case of the third charging means 130, a charge receiving material that is an object to be charged is a toner image formed on the transfer belt 41, and the transfer belt 41 is provided between the discharge electrode 1 and the counter electrode 3 of the ion generating means 20 in such a manner as to face the discharge electrode 1 while closely touching the counter electrode 3. In the case of the third charging means 130, ions generated by the ion generating means 20 flow toward the counter electrode 3, and charge a toner image formed on the transfer belt 41 moving at a predetermined peripheral velocity.

As described above, in the image forming apparatus 200, each of the first and second charging means for charging the photoreceptor 31 that is an image bearing member and the third charging means for charging a toner image formed on the transfer belt 41 that is an intermediate transfer member is made of the charging device 100. Consequently, it is possible to prevent discharge products from attaching to the photoreceptor 31 and the transfer belt 41. Therefore, when the image forming apparatus 200 forms a recording image on the recording paper 60, it is possible to prevent generation of image defects such as white spots and image deletions due to attachment of the discharge products to the photoreceptor 31 or the transfer belt 41. Further, since generation of highly oxidative ozone is prevented, it is possible to prevent members of the image forming apparatus 200 from being oxidized and deteriorated.

Further, each of the second charging means 120 and the third charging means 130 included in the image forming apparatus 200 is made of the charging device 100, and therefore it is possible to prevent generation of a corona wind. Consequently, it is possible to prevent a toner image formed on the photoreceptor 31 and the transfer belt 41 from being charged in a disturbed manner. Further, since the second charging means 120 and the third charging means 130 charge a toner image, the charge amount of the toner image can be increased, so that it is possible to transfer the toner image with a high transfer efficiency.

Further, in the image forming apparatus 200, each of the first and second charging means for charging the photoreceptor 31 and the third charging means for charging the transfer belt 41 is made of the charging device 100 with a high usage efficiency of ions. Consequently, even when the photoreceptor 31 and the transfer belt 41 are driven at a high velocity, it is possible to sufficiently charge the photoreceptor 31 and the transfer belt 41. Therefore, each of the first, second and third charging means made of the charging device 100 is applicable to a high-velocity image forming apparatus in which printing is performed at a high velocity.

EXAMPLES

The following explains Examples, Reference Examples, and Comparative Example each employing the ion generating device of the present invention. Here, an explanation is made as to a relationship between an arrangement of the ion generating device 21 or a method for producing the ion generating device 21 and characteristics thereof. First, the ion generating devices of Examples, Reference Examples, and Comparative Example (Examples 1-6, Reference Examples 1 and 2, and Comparative Example) were produced while the following conditions (parameters) were differentiated, and the ion generating devices were evaluated in terms of three points: uniformity in discharge, uniformity in image quality, and durability. Conditions of the ion generating device that were not described in the following were determined according to the method and the size that were described above.

<Conditions for Producing Ion Generating Device>

(1) Protective Layer

Ion generating devices with the protective layer (coat layer) 6 on the discharge electrode 1 and ion generating devices without the protective layer 6 on the discharge electrode 1 were prepared. In Examples 1-3, 5, and 6 and Reference Example 1, the protective layer 6 was not provided. In Example 4, Reference Example 2, and Comparative Example, the protective layer 6 was provided.

(2) Step of Printing Discharge Electrode

Figure 5A:
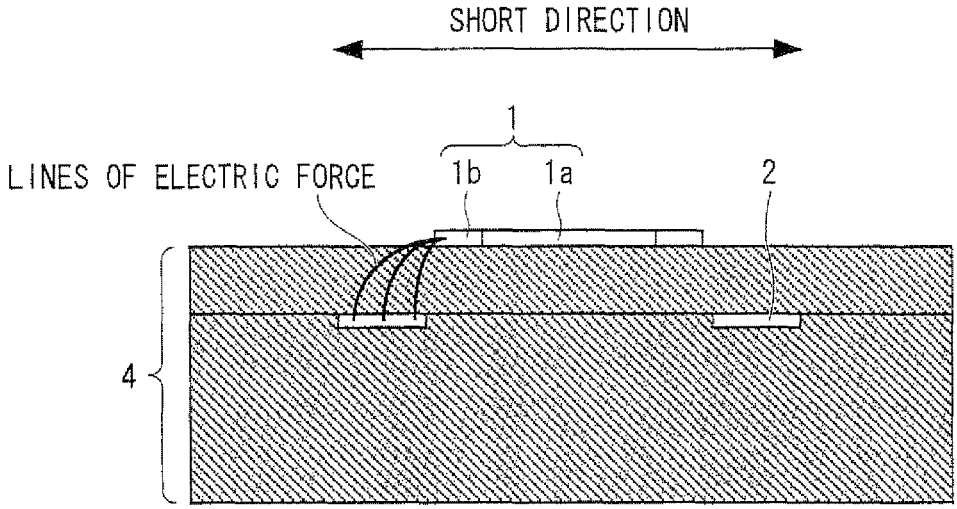
FIG. 5(*a*) is a drawing illustrating a state where a discharge electrode of an ion generating device is exposed from a top surface of a dielectric body.
Figure 5B:
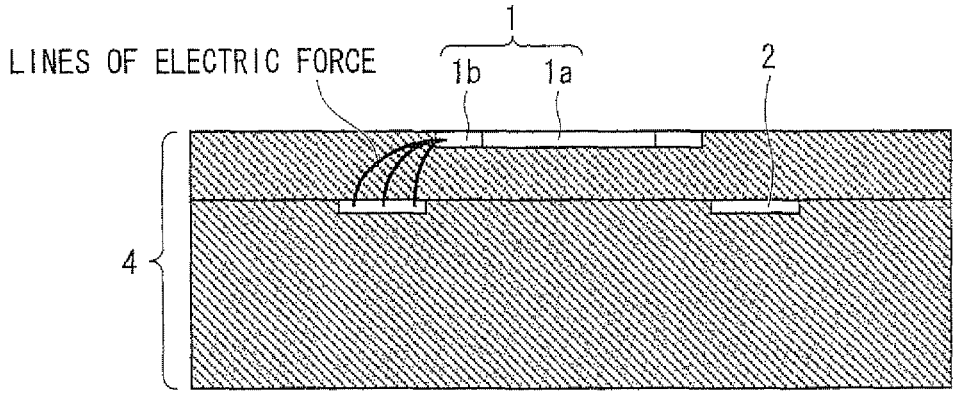

The discharge electrode 1 was printed before the step of WIP or after the step of WIP. As explained in the above embodiment, the ion generating device 21 is produced by causing the upper dielectric body 4*a* and the lower dielectric body 4*b* to be attached to and pressed to each other by a press jig (WIP). The discharge electrode 1 is formed on the upper dielectric body 4*a* through screen printing. In a case where the discharge electrode 1 is formed after the step of WIP, the discharge electrode 1 is exposed from the upper surface of the upper dielectric body 4*a* as illustrated in FIG. 5(*a*). In contrast thereto, in a case where the discharge electrode 1 is formed before the step of WIP, the discharge electrode 1 is embedded in the upper dielectric body 4*a* due to application of a pressure by the press jig, as illustrated in FIG. 5(*b*). In Examples 1-6 and Reference Example 2, the discharge electrode 1 was formed before the step of WIP. That is, in Examples 1-6 and Reference Example 2, the discharge electrode 1 was formed in such a manner as to be embedded in the upper dielectric body 4*a*. In Reference Example 1 and Comparative Example, the discharge electrode 1 was formed after the step of WIP.

(3) Shape of Discharge Electrode

As illustrated in FIG. 6(*a*-2) or FIG. 6(*b*-2), the shape of the discharge electrode 1 was a saw-tooth shape in which discharge sections 1*b* with pointed edges were protruded from a periphery of a base section 1*a* having a rectangular shape. That is, the discharge sections 1*b* protruded from the base section 1*a* in a direction that was perpendicular to a long direction of the discharge electrode 1 and that was perpendicular to a direction in which the discharge electrode 1 was laminated. Here, a width of the discharge electrode 1 including the discharge sections 1*b* that were perpendicular to the long direction of the discharge electrode 1 and that were perpendicular to a direction in which the discharge electrode 1 was laminated was regarded as H, and a width of the base section 1*a* that was perpendicular to the long direction of the discharge electrode 1 and that was perpendicular to a direction in which the discharge electrode 1 was laminated was regarded as W. By differentiating H and W as shown in the following (a) and (b), two kinds of ion generating devices with different W/H were prepared.

(a) H=300 μm, W=100 μm, W/H=0.33 (see FIG. 6(*a*-2))

(b) H=500 μm, W=300 μm, W/H=0.6 (see FIG. 6(*b*-2))

In Example 1, Reference Example 1, and Comparative Example, W/H=0.33. In Examples 2-6 and Reference Example 2, W/H=0.6.

(4) Shape of Inductive Electrode

In terms of the shape of an inductive electrode, two kinds of ion generating devices were produced: one ion generating device had the inductive electrode 2 that was plate-shaped in such a manner as to completely overlap the discharge electrode 1 as illustrated in FIGS. 6(*a*-1) and 6(*a*-2) (when projected in a lamination direction, the shape of the projected inductive electrode 2 completely included the shape of the projected discharge electrode 1; and the other ion generating device had the inductive electrode 2 that was U-shaped in such a manner as to surround the discharge electrode 1 so as not to overlap the discharge electrode 1 at all as illustrated in FIGS. 6(*b*-1) and 6(*b*-2) (when projected in a lamination direction, the shape of the projected discharge electrode 1 and the shape of the projected inductive electrode 2 did not overlap each other at all).

In Examples 1 and 2, Reference Example 1, and Comparative Example, the inductive electrode 2 was plate-shaped. In Examples 3-6 and Reference Example 2, the inductive electrode 2 was U-shaped.

(5) Material for Protective Layer

The following three kinds of materials (coating materials) were used for the protective layer 6.

(a) LTCC (coating material with high viscosity. For example, FIG. 11(*b*))

LTCC used for the dielectric body 4 was made to be a paste form (viscosity 300 Pa·s) by an organic solution and formed through screen printing, and sintered simultaneously with the dielectric body 4 (ceramic substrate), and thus a protective layer 6*b* made of LTCC was formed. The thickness of the protective layer 6*b* ranged from 10 to 20 μm. The thickness was measured by measuring the difference between upper and lower surfaces of the end of the protective layer 6*b* with use of a tracer-type surface roughness tester. In Comparative Example, as described above, the protective layer 6 was the protective layer 6*b* made of LTCC.

(b) Silicon dioxide (coating material with low viscosity. For example, FIG. 11(*a*))

The dielectric body 4 (ceramic substrate) was sintered and then a protective layer material with low viscosity mainly made of a glass material (silicon dioxide) was applied on the discharge electrode 1 through dipping and sintered, and thus a protective layer (protective layer mainly made of a glass material) 6*a* was formed. In the present embodiment, the material of the protective layer 6*a* with low viscosity was a glass coating material manufactured by OSAKA ORGANIC CHEMICAL Industry LTD. (trade name: Skymic, product class: HRC-clear-, viscosity 4.8 mPa·s). The protective layer material formed through screen printing was sintered simultaneously with the dielectric body 4. In contrast thereto, since the temperature at which the coating material formed through dipping was sintered at 150-200° C. which was lower than the temperature for sintering the dielectric body (approximately 850° C.), the dielectric body 4 was sintered and then the protective layer was formed through dipping and sintered at 200° C. The thickness of the protective layer 6*a* mainly made of silicon dioxide was approximately 4 μm. The thickness was measured by converting a change in weight of the ion generating device 21 before and after coating. In Reference Example 2, the protective layer 6 was the protective layer 6*a* mainly made of a glass material (silicon dioxide).

(c) Nickel and gold (For example, FIG. 1(*b*))

After sintering the dielectric body 4 (ceramic substrate), a protective layer 6*c* made of nickel and gold was formed on the discharge electrode 1 through electrolytic plating. The thickness of the protective layer 6*c* was approximately 4 μm in total including 3-4 μm of nickel and approximately 0.2 μm of gold. In Example 4, as described above, the protective layer 6 was the protective layer 6*c* made of nickel and gold.

(6) Material for Discharge Electrode

The following three kinds of materials were used for the material for the discharge electrode 1. The discharge electrode 1 made of each material was formed on the dielectric body 4 through screen printing.

(a) Paste material mainly made of silver palladium (b) Paste material mainly made of gold (c) Paste material mainly made of tungsten In Examples 1-4, Reference Examples 1 and 2, and Comparative Example, the material for the discharge electrode 1 was the paste material mainly made of silver palladium. In Example 5, the material was the paste material mainly made of gold. In Example 6, the material was the paste material mainly made of tungsten. In the cases of silver palladium and gold, an LTCC substrate was used for the dielectric body 4. In the case of tungsten, an alumina substrate was used for the dielectric body 4 in view of sintering temperature.

The ion generating devices (Examples 1-6, Reference Examples 1 and 2, Comparative Example) produced with different conditions as described above will be shown in Table 1 that will be presented later.

<Evaluation Experiment>

(1) Uniformity in Discharge

Figure 7A:
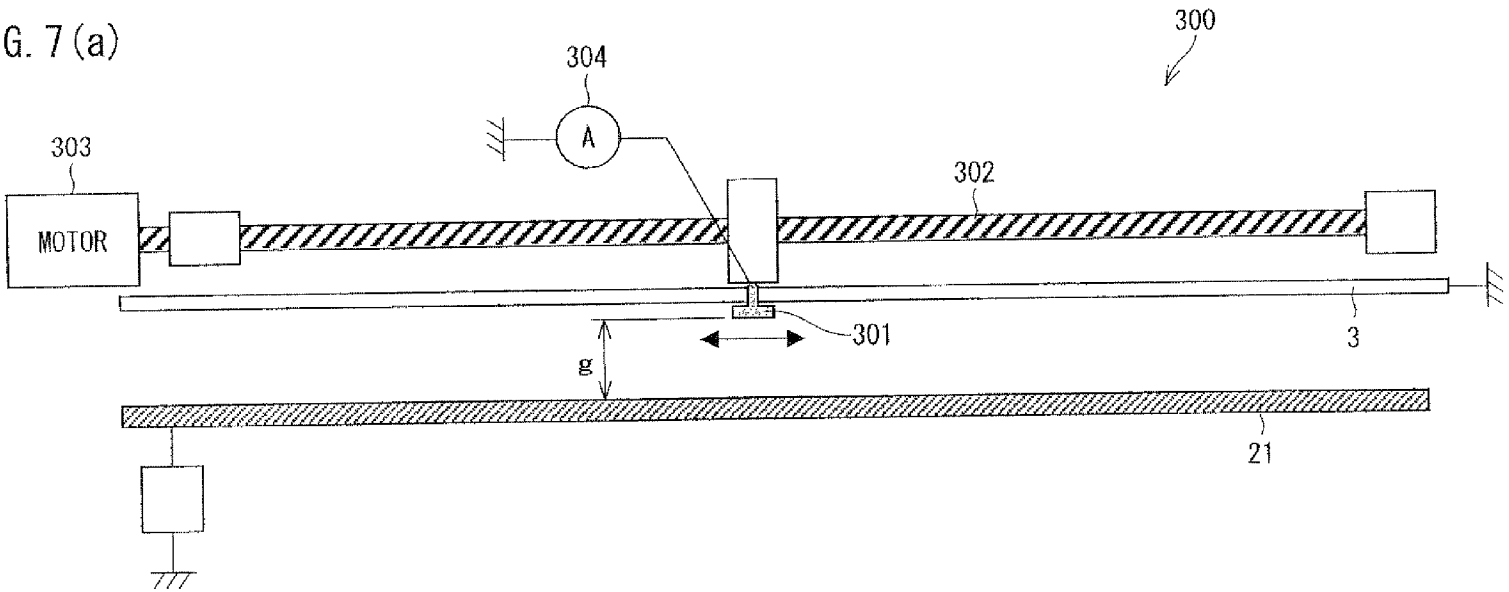
FIG. 7(*a*) is a top drawing illustrating a measurement device for measuring discharge distribution of an ion generating device.
Figure 7B:
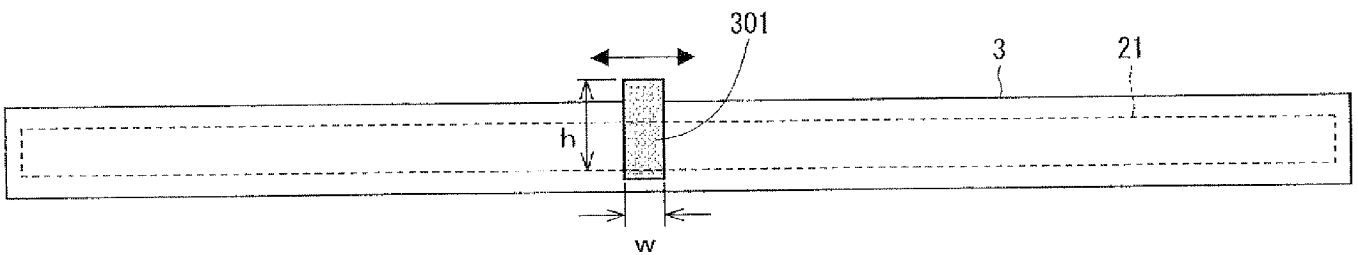

With reference to FIGS. 7(*a*), 7(*b*), and 8, the following explains a method for evaluating uniformity in discharge of the ion generating device 21. FIGS. 7(*a*) and 7(*b*) are drawings each illustrating a measurement device 300 for measuring discharge distribution of the ion generating device 21. FIG. 7(*a*) is a top drawing and FIG. 7(*b*) is an elevation drawing. The measurement device 300 includes a measurement electrode 301, a counter electrode 3, a measurement electrode moving mechanism 302, a motor 303, and an amperemeter 304.

The measurement electrode 301 is a stainless electrode of 2 mm in width and 5 mm in height (w×h), and is attached to the measurement electrode moving mechanism 302. The measurement electrode moving mechanism 302 is made of a ball screw and moves the measurement electrode 301 by rotation of the motor 303. The measurement electrode 301 is grounded via the amperemeter 304 so that a discharge current flowing into the measurement electrode 301 is measured. Further, the counter electrode 3 made of stainless steel that is grounded is provided at the back surface of the measurement electrode 301. Further, the ion generating device 21 is fixed by a supporting member (not shown) with a certain distance (g=5 mm) from the measurement electrode 301.

While applying a voltage on the ion generating device 21 to generate ions, the measurement electrode 301 is caused to move in a long direction of the ion generating device 21 and the amperemeter 304 measures a current flowing in the measurement electrode 301. Thus, distribution of a discharge current in a long direction of the ion generating device 21 is measured.

Figure 8:
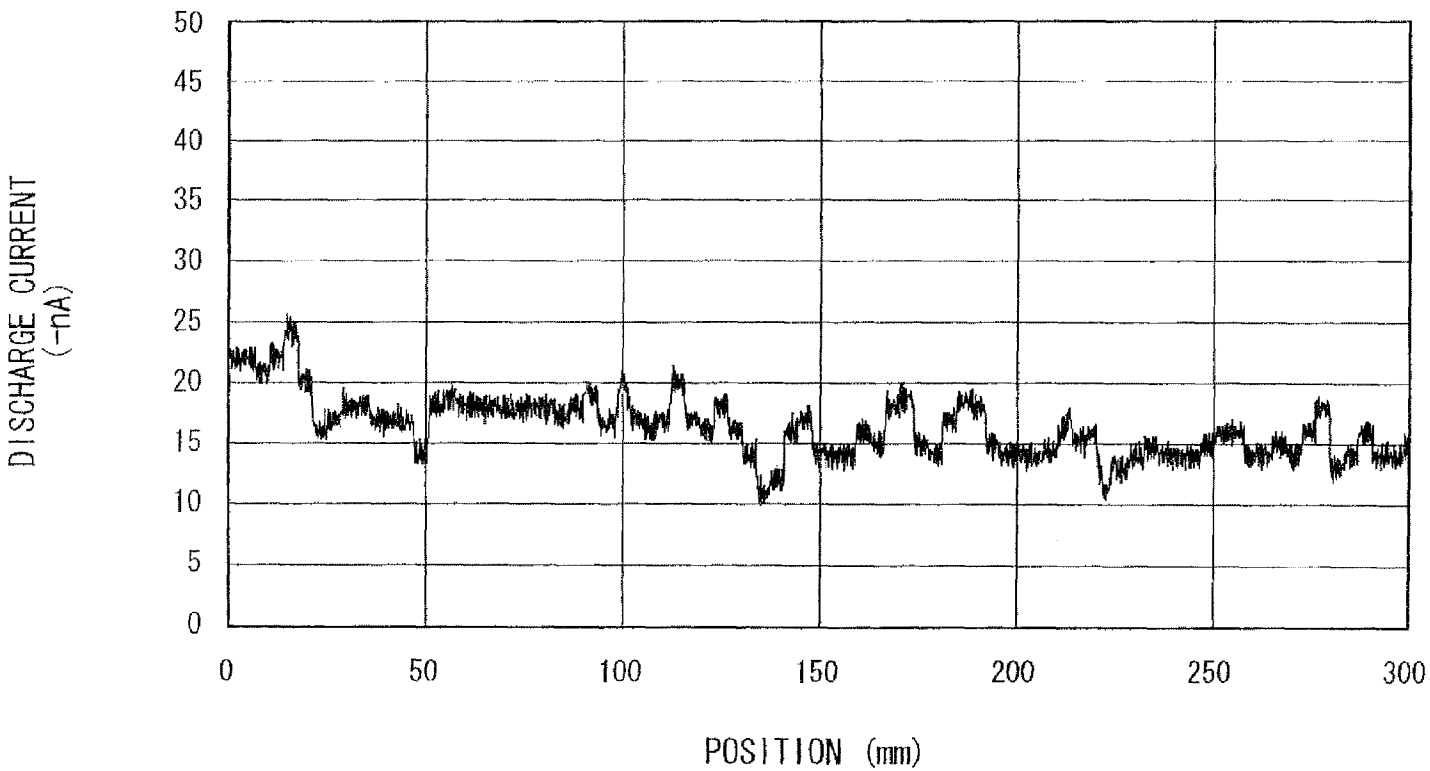
FIG. 8 is a drawing illustrating an example of data indicative of distribution of a discharge current measured by the measurement device in FIGS. 7(*a*) and 7(*b*).

FIG. 8 is a drawing illustrating an example of data indicative of distribution of a discharge current that was measured by the measurement device 300. A fluctuation coefficient (standard deviation/average value) for the distribution of a discharge current was obtained from the data indicative of the distribution of a discharge current, and the ion generating devices were evaluated in terms of uniformity in discharge in accordance with the following standard. The standard was such that the ion generating device whose fluctuation coefficient was not more than 10% was evaluated as "◎", the ion generating device whose fluctuation coefficient ranged from 10 to 20% was evaluated as "○", the ion generating device whose fluctuation coefficient ranged from 20 to 30% was evaluated as "○ Δ", the ion generating device whose fluctuation coefficient ranged from 30 to 40% was evaluated as "Δ|", and the ion generating device whose fluctuation coefficient was not less than 60% was evaluated as "X."

(2) Uniformity in Image Quality

Uniformity in image quality in cases where the ion generating devices were applied to the charging means 130 before transferring a record was evaluated. Specifically, the charging means 130 including the ion generating devices, respectively, were produced and the charging means 130 were applied to a color multi-function printer MX-4500 manufactured by Sharp Corporation that was the image forming apparatus 200. In the charging means 130, the ion generating device 21 was provided to face the transfer belt 41 with a gap g between the discharge electrode 1 and the transfer belt 41 being 5 mm, and the counter electrode 3 closely touched the transfer belt 41 to face the discharge electrode 1 with the transfer belt 41 between the counter electrode 3 and the discharge electrode 1. In this state, a pulse voltage was applied on the discharge electrode 1 so that approximately 10 μA of a counter electrode current flowed in the counter electrode 3. At that time, the image forming apparatus 200 printed a halftone image on recording paper and uniformity of the halftone image on the recording paper was evaluated (six levels) through visual observation. That is, evaluation was made in terms of the levels and numbers of white streaks and black streaks that impaired image quality (uniformity) of a halftone image, and uniformity of the halftone image was evaluated as "◎", "|○|", "○|Δ|", "Δ|", "ΔX", "X" in the order from good to bad.

(3) Durability

Figure 9:
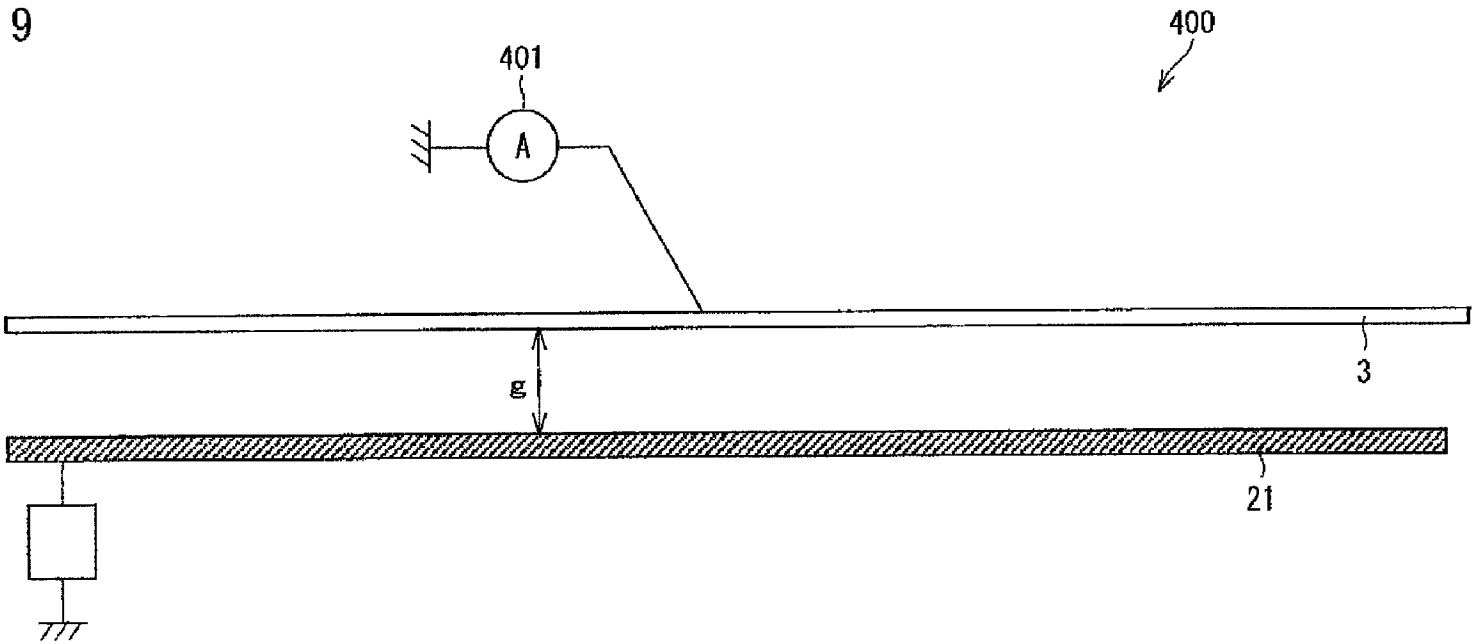
FIG. 9 is a drawing illustrating an evaluation device for evaluating durability of an ion generating device.

With reference to FIG. 9, the following explains a method for evaluating durability of the ion generating device. FIG. 9 is a drawing illustrating an evaluation device 400 for evaluating durability of the ion generating device 21. The evaluation device 400 includes a counter electrode 3 and an amperemeter 401. The counter electrode 3 is a stainless electrode and is grounded via the amperemeter 401 so that a discharge current flowing into the counter electrode 3 is measured. Further, the ion generating device 21 is fixed by a supporting member (not shown) with a certain distance (g=5 mm) from the counter electrode 3.

While keeping application of a voltage on the ion generating device 21 so that the ion generating device 21 kept generating ions, evaluation of image quality explained in the above (2) (evaluation through visual observation) was performed periodically, and there were examined (i) a time for discharge until uniformity of a halftone image became equal to or less than an allowable value and (ii) a time it took for the discharge electrode to break, and the ion generating devices were evaluated in terms of durability in accordance with the following standard.

The ion generating device for which it took not less than 200 hours until image quality became equal to or less than the allowable value was evaluated as "◎", the ion generating device for which it took 100-200 hours until image quality became equal to or less than the allowable value was evaluated as "○", the ion generating device for which it took 60-100 hours until image quality became equal to or less than the allowable value was evaluated as "○Δ|", the ion generating device for which it took 30-60 hours until image quality became equal to or less than the allowable value was evaluated as "Δ", the ion generating device for which it took 10-30 hours until image quality became equal to or less than the allowable value was evaluated as "ΔX|", and the ion generating device for which it took not more than 10 hours until image quality became equal to or less than the allowable value was evaluated as "X."

Image quality could not be evaluated at the time when the discharge electrode broke. Accordingly, in a case where the discharge electrode 1 broke first, a time it took until image quality became equal to or less than the allowable value was the same as a time it took until the discharge electrode 1 broke.

<Result of Evaluation>

Table 1 shows the conditions for the ion generating devices produced as described above and the results of evaluation experiments of the ion generating devices. Comparative Example was a conventional ion generating device. Examples 1 to 6 were the ion generating devices according to the present invention. Reference Examples 1 and 2 were the ion generating devices according to reference embodiments of the present invention.

TABLE 1

| Conditions | Comparative Example | Reference Example 1 | Example 1 | Example 2 | Example 3 | Reference Example 2 | Example 4 | Example 5 | Example 6 |
|---|---|---|---|---|---|---|---|---|---|
| Material for substrate (dielectric body) | Ceramic (LTCC) | Ceramic (LTCC) | Ceramic (LTCC) | Ceramic (LTCC) | Ceramic (LTCC) | Ceramic (LTCC) | Ceramic (LTCC) | Ceramic (LTCC) | Ceramic (alumina) |
| Discharge electrode | Silver palladium | Silver palladium | Silver palladium | Silver palladium | Silver palladium | Silver palladium | Silver palladium | Gold paste | W |
| Method for forming discharge electrode | Screen printing | Screen printing | Screen printing | Screen printing | Screen printing | Screen printing | Screen printing | Screen printing | Screen printing |
| Printing of discharge electrode | After WIP | After WIP | Before WIP | Before WIP | Before WIP | Before WIP | Before WIP | Before WIP | Before WIP |
| Protective layer/plating (thickness: μm) | LTCC (10-20) | None | None | None | None | Silicon dioxide (4) | Nickel gold plating (4) | None | None |
| Shape of discharge electrode (W/H) | W = 100 μm H = 300 μm (W/H = 0.33) | W = 100 μm H = 300 μm (W/H = 0.33) | W = 100 μm H = 300 μm (W/H = 0.33) | W = 300 μm H = 500 μm (W/H = 0.6) | W = 300 μm H = 500 μm (W/H = 0.6) | W = 300 μm H = 500 μm (W/H = 0.6) | W = 300 μm H = 500 μm (W/H = 0.6) | W = 300 μm H = 500 μm (W/H = 0.6) | W = 300 μm H = 500 μm (W/H = 0.6) |
| Shape of inductive electrode (overlap exists or not) | Plate shape (exists) | Plate shape (exists) | Plate shape (exists) | Plate shape (exists) | U shape (Not) | U shape (Not) | U shape (Not) | U shape (Not) | U shape (Not) |
| Uniformity in discharge | XΔ | ○ | ○ | ○ | ○ | ○ | ◎ | ◎ | ○ |
| Uniformity in image quality | X | ○ | ○ | ○ | ○ | ○ | ◎ | ◎ | ○ |
| Durability (image quality) | X | ΔX | Δ | ○Δ | ○Δ | ○ | ○ | ◎ | ◎ |
| Durability (breakage) | ○Δ | ΔX | Δ | ○Δ | ○ | ○ | ◎ | ◎ | ◎ |

(1) Presence/Absence of Protective Layer

The result of comparison between Comparative Example and Reference Example 1 shows that providing no protective layer allows great increases in uniformity in discharge and uniformity in image quality compared with providing the protective layer 6*b* made of LTCC. The reason is explained below with reference to FIGS. 11(*b*) and 11(*c*). Uniformity in discharge is influenced by uniformity in the protective layer 6. If the protective layer 6 is thin or has pinholes, cracks, voids etc., too much discharge occurs (image defects in black streaks). If the protective layer 6 is thick, too little discharge occurs (image defects in white streaks).

Figure 11:
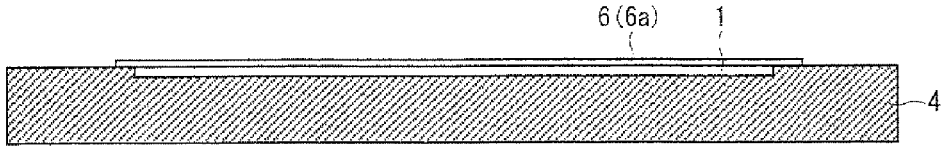
FIG. 11(*a*) is a cross sectional drawing illustrating an ion generating device provided with a protective layer mainly made of a glass material.
Figure 11:
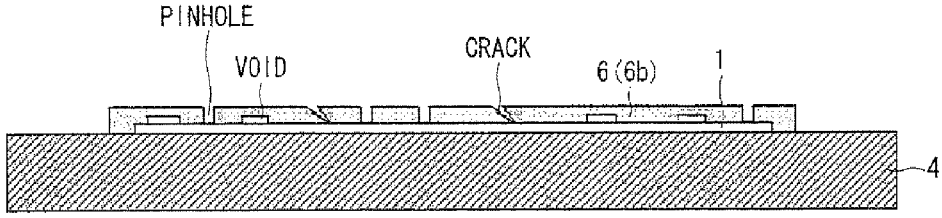
Figure 11:
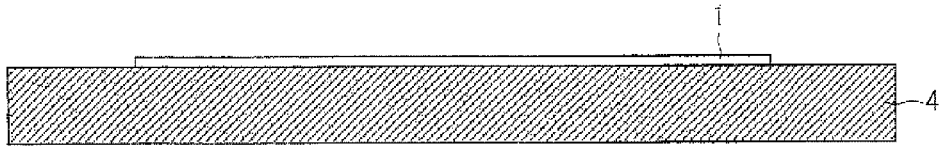
Figure 12:
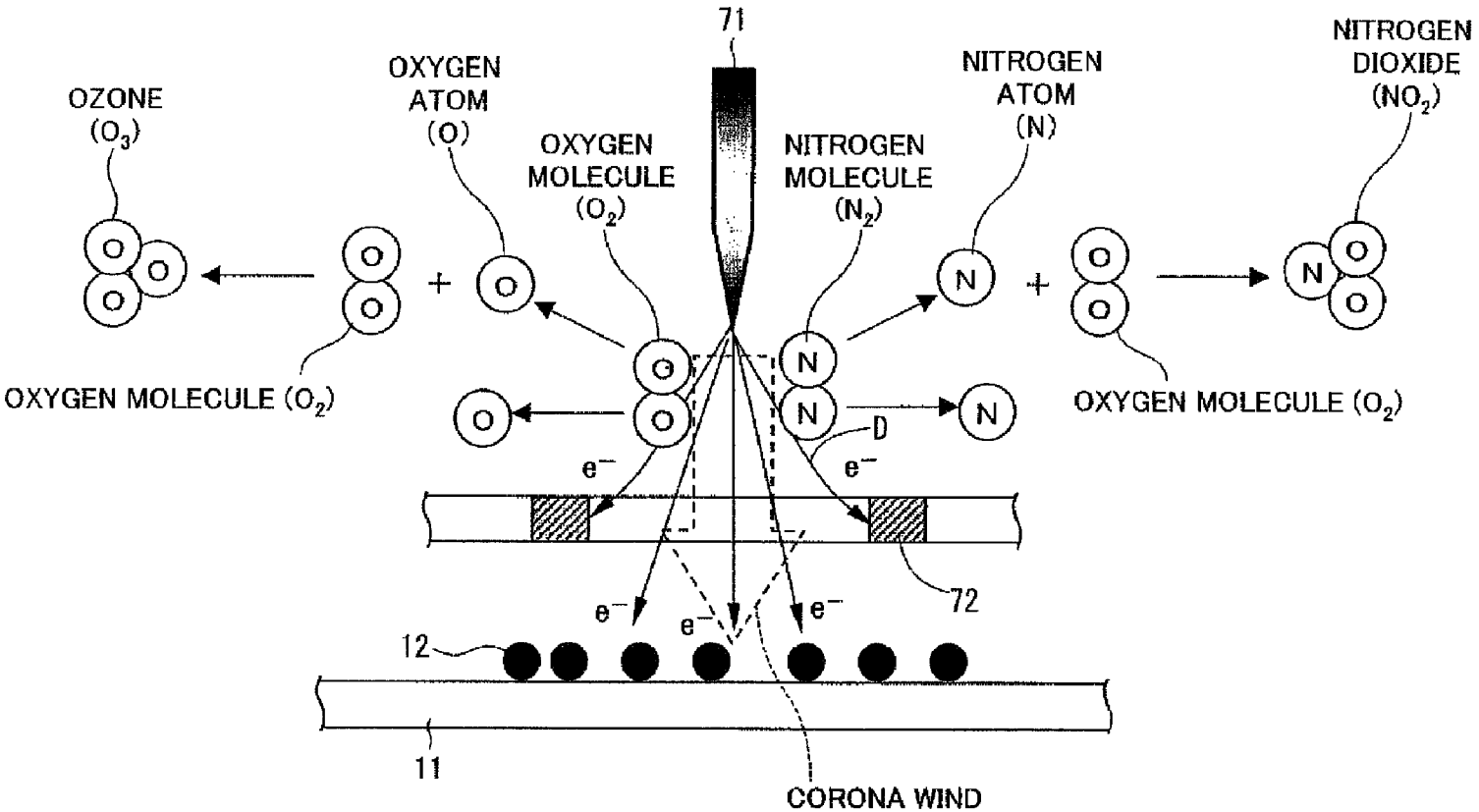
FIG. 12 is a drawing illustrating a mechanism of charging in a charging device employing a corona discharge system.

When the protective layer 6 is formed through screen printing, the protective layer 6 is likely to have uneven thickness as illustrated in FIG. 11(*b*) due to a change in pressure caused by moving of a squeegee, variation in pressure in a long direction, etc. Further, when the paste viscosity is high, pinholes and voids are likely to occur.

Therefore, as illustrated in FIG. 11(*c*), without providing the protective layer 6 that is the cause for variation in discharge, uniformity in discharge and uniformity in image quality increase. However, the protective layer has a function for preventing deterioration of a discharge electrode due to discharge energy. Consequently, providing no protective layer 6 results in decrease in durability and a shorter life.

(Step of Printing a Discharge Electrode)

The result of comparison between Reference Example 1 and Example 1 shows that printing the discharge electrode 1 before the WIP step (Example 1) allows better durability than printing the discharge electrode 1 after the WIP step (Reference Example 1). The reason why printing the discharge electrode 1 before the WIP step allows better durability is explained below. As illustrated in FIG. 5(*a*), when the discharge electrode is printed after the WIP step, an end of the discharge section 1*b* of the discharge electrode 1 is formed while exposed from an upper surface of the dielectric body (ceramic substrate) 4. In contrast thereto, as illustrated in FIG. 5(*b*), when the discharge electrode 1 is printed before the WIP step, the discharge electrode 1 is embedded in the dielectric body 4 (ceramic substrate) through the WIP step. Consequently, an end of the discharge section 1*b* of the discharge electrode 1 is formed while embedded in the dielectric body 4. When the discharge electrode 1 is embedded in the dielectric body 4, the end of the discharge section 1*b* where discharge energy is concentrated (lines of electric force are concentrated) is protected by the dielectric body 4, which increases durability, resulting in a longer life.

(Shape of Discharge Electrode)

The result of comparison between Example 1 and Example 2 shows that when the shape of the discharge electrode 1 is designed so that a ratio of the width W of the base section 1*a* to the width H of the whole discharge electrode 1, i.e. W/H is larger, durability gets better. The reason is explained below with reference to FIGS. 10(*a*) and 10(*b*). In a case where the discharge electrode 1 is not provided with the protective layer 6 and the material of the discharge electrode 1 is an easily oxidizable material such as silver palladium, the discharge electrode 1 gets oxidized (blackened) with time due to discharge energy. There is a case where not only the discharge sections 1*b* but also the base section 1*a* are oxidized according to usage conditions such as the strength of the discharge energy and the length of a life. Consequently, in a case where W/H=0.33 and the width of the base section 1*a* is narrow as in Example 1, oxidization proceeds to the base section 1*a*. Since the oxidized portion has higher electric resistance, the oxidized base section 1*a* illustrated in FIG. 10(*a*) cannot evenly supply a current to the discharge section 1*a*, resulting in non-uniformity in discharge, or in a worse case, breakage of the discharge electrode 1.

Figure 10A:
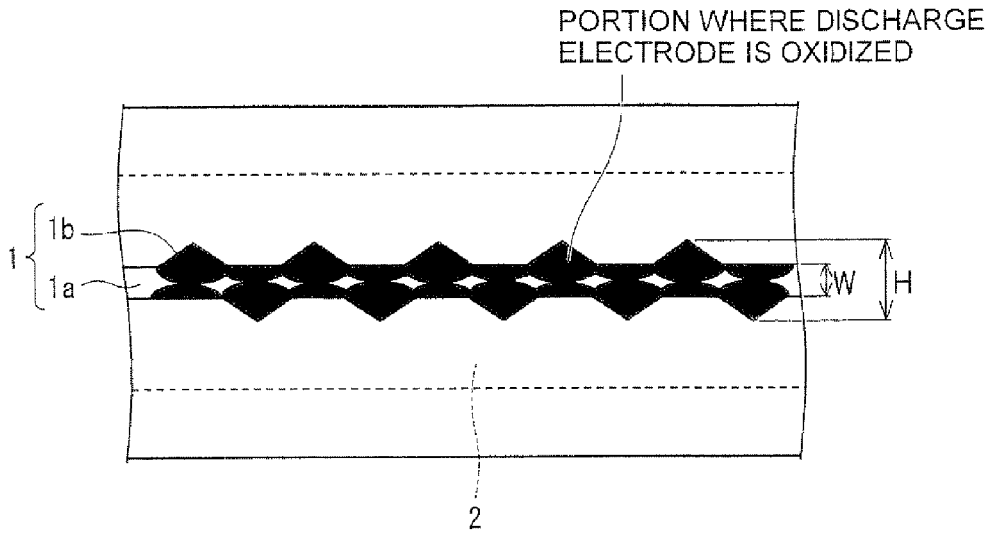
FIG. 10(*a*) is a plan drawing illustrating oxidization of an ion generating device in which a discharge electrode has a narrow base section and an inductive electrode has a plane-shape.
Figure 10B:
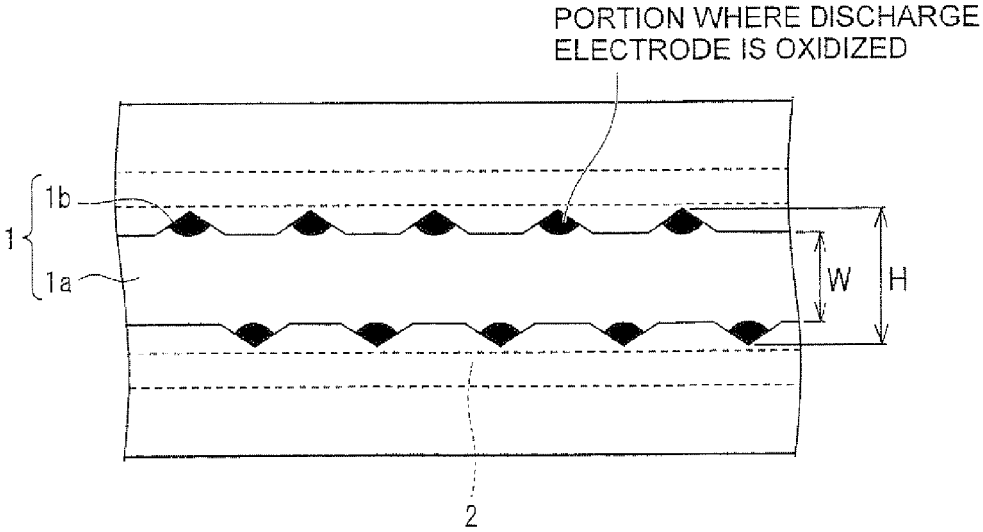

In contrast thereto, in a case where W/H=0.6 and the base section 1*a* is wide as in Example 2, even when oxidization proceeds at the base section 1*a*, unoxidized portions remain continuously as illustrated in FIG. 10(*b*). This allows evenly supplying a current to individual discharge sections without breaking the discharge electrode 1. Note that, since the discharge sections 1*b* are oxidized and have higher electric resistance, the same conditions for applying a voltage (conditions such as peak voltage and frequency) would decrease discharge performance compared with an initial state. However, chronological correction of the conditions for applying a voltage, such as gradual increases in the peak voltage and frequency, allows preventing the oxidization from increasing electric resistance.

(Shape of Inductive Electrode)

The result of comparison between Example 2 and Example 3 shows that the inductive electrode 2 designed to have a U-shape (without overlapping the discharge electrode) has better durability than the inductive electrode 2 designed to have a plane shape (overlapping the discharge electrode).

The reason why the inductive electrode 2 designed to have a U-shape has better durability is explained below. When the inductive electrode 2 is designed to have a plane shape as in Example 2, the discharge electrode 1 and the inductive electrode 2 overlap (face) each other. Consequently, not only the discharge sections 1*b* of the discharge electrode 1 face the inductive electrode 2 but also the base section 1*a* of the discharge electrode 1 faces the inductive electrode 2. As a result, not only the discharge sections 1*b* discharge, but also the base section 1*a* discharges a little. Therefore, as illustrated in FIG. 10(*a*), oxidization due to discharge proceeds not only at the discharge sections 1*b* but also at the base section 1*a*. The oxidized portion has higher electric resistance. Consequently, when oxidization proceeds also at the base section 1*a* as illustrated in FIG. 10(*a*), it becomes impossible to evenly supply a current to the discharge sections 1*b*, resulting in non-uniformity in discharge, and in a worse case, breakage of the discharge electrode 1.

In contrast thereto, when the inductive electrode 2 is designed so that the inductive electrode 2 has a U-shape surrounding the discharge electrode 1 and that the inductive electrode 2 and the discharge electrode 1 do not overlap (face) each other, discharge occurs only at ends of the discharge sections 1*b* and does not occur at the base section 1*a*. Consequently, it is possible to prevent oxidization of the base section 1*a*, eliminating the possibility of breakage of the discharge electrode 1 and allowing evenly supplying a current to individual discharge sections.

Since the discharge sections 1*b* are oxidized and have higher electric resistance, the same conditions for applying a voltage (conditions such as peak voltage and frequency) would decrease discharge performance compared with an initial state. However, chronological correction of the conditions for applying a voltage, such as gradual increases in the peak voltage and frequency, allows preventing the oxidization from increasing electric resistance.

(Coating Material)

(1) Silicon Dioxide (Coating Material with Low Viscosity)

The result of comparison between Comparative Example and Reference Example 2 shows that the protective layer 6 obtained by dip-processing a glass material (silicon dioxide) has better uniformity in discharge and better uniformity in image quality than the protective layer 6 obtained by screen-printing a ceramic material (LTCC).

The reason is explained below with reference to FIGS. 11(*a*) and 11(*b*). Uniformity in discharge is influenced by uniformity in the protective layer 6. If the protective layer 6 is thin or has pinholes, cracks, voids etc., too much discharge occurs (image defects in black streaks). If the protective layer 6 is thick, too little discharge occurs (image defects in white streaks). In a case of LTCC, since the material for the protective layer 6 (coating material) is viscous, only screen printing allows formation of the protective layer 6. Consequently, the protective layer 6 is likely to have uneven thickness as illustrated in FIG. 11(*b*) due to a change in pressure caused by moving of a squeegee, variation in pressure in a long direction, etc. Further, since the paste viscosity is high, pinholes and voids are likely to occur.

In contrast thereto, since a coating material mainly made of a glass material (coating material mainly made of silicon dioxide) has low viscosity, it is possible to form the protective layer 6 through a dip process. Consequently, as illustrated in FIG. 11(*a*), the protective layer 6 obtained by dip-processing the glass material has no pinholes, no cracks, and no voids, and is thinner (approximately 4 μm in the present Example) and has better uniformity, compared with the protective layer 6 made of LTCC. This allows both ensuring uniformity in discharge and a longer life.

Further, the result of comparison between Example 3 and Reference Example 2 shows that providing the protective layer 6*a* mainly made of a glass material (silicon dioxide) ensures better durability than providing no protective layer 6. This is because the protective layer 6*a* mainly made of a glass material protects the discharge electrode and thus prevents deterioration and oxidization of the discharge electrode due to discharge.

A method for coating the coating material with low viscosity is not limited to dipping, and may be any application method such as spray application and roll application.

(2) Nickel and Gold

The result of comparison between Example 3 and Example 4 shows that providing the discharge electrode 1 with a protective layer 6*c* made of nickel and gold through plating further increases uniformity in discharge and uniformity in image quality than providing no protective layer 6. The reason is explained below with reference to FIGS. 1(*a*) and 1(*b*). FIGS. 1(*a*) and 1(*b*) are drawings each illustrating a cross section of the ion generating device 21 in a long direction. As described above, since the discharge electrode 1 as well as the protective layer 6 are formed through screen printing, voids exist also inside the discharge electrode 1 as illustrated in FIGS. 1(*a*) and 1(*b*).

As illustrated in FIG. 1(*a*), in a case where a current is supplied from an end of the ion generating device 21 via a power-supply electrode, a current flows in the discharge electrode 1, and consequently variation in distribution of voids in the discharge electrode 1 causes variation in distribution of a current in a long direction of the ion generating device 21. Consequently, although not so influential as variation in the protective layer 6, the variation in distribution of voids in the discharge electrode 1 also influences uniformity in discharge and uniformity in image quality.

In contrast thereto, in a case where the discharge electrode 1 is provided with the protective layer 6*c* made of nickel and gold (nickel-gold plating layer) through plating, the nickel-gold plating layer does not have voids and is formed evenly compared with the discharge electrode 1, as illustrated in FIG. 1(*b*).

Further, since the plating material (nickel and gold) has smaller electric resistance (approximately one-third) than the material for the discharge electrode 1 (silver palladium), a current supplied from the power-supply electrode flows mainly in the nickel-gold plating layer 6*c*. Consequently, distribution of a current gets even in a long direction of the ion generating device 21, thereby increasing uniformity in discharge and uniformity in image quality.

Further, the result of comparison between Example 3 and Example 4 shows that providing the nickel-gold plating layer 6*c* ensures better durability than providing no protective layer 6. This is because the nickel-gold plating layer 6*c* protects the discharge electrode 1, thereby preventing deterioration and oxidization of the discharge electrode 1 due to discharge.

(Material for Discharge Electrode)

The result of comparison among Examples 3, 5, and 6 shows that a case where the discharge electrode 1 is mainly made of gold (Example 5) or tungsten (Example 6) ensures better durability than a case where the discharge electrode 1 is mainly made of silver palladium (Example 3). This is because gold and tungsten are less likely to oxide and less likely to be deteriorated due to discharge than the material mainly made of silver or silver palladium.

Further, the result of comparison between Example 3 and Example 5 shows that a case where the discharge electrode 1 is mainly made of gold (Example 5) ensures further higher uniformity in discharge and uniformity in image quality than a case where the discharge electrode 1 is mainly made of silver palladium (Example 3). This is because the discharge electrode 1 mainly made of gold has smaller electric resistance (approximately one-third) than the discharge electrode 1 mainly made of silver palladium, and consequently is less likely to be influenced by voids in the discharge electrode 1.

The ion generating device of the present invention is not limited to Examples. Various combinations of conditions such as the state of the discharge electrode 1 (whether the discharge electrode 1 is embedded in the dielectric body or not), the shape of the discharge electrode 1 (W/H), the shape of the inductive electrode 2 (plane-shape or U-shape), and the material for the discharge electrode 1 (silver palladium, gold, and tungsten) are possible as long as the protective layer 6 made of a metal is provided or the discharge electrode is directly exposed to the atmosphere without the protective layer.

As described above, the ion generating device of the present invention is an ion generating device, including: a discharge electrode on a dielectric body; and an inductive electrode on a plane of the dielectric body that is opposite to a plane where the discharge electrode is formed, the ion generating device generating ions through creeping discharge caused by applying a voltage across the discharge electrode and the inductive electrode so that a potential difference exists between the discharge electrode and the inductive electrode, a surface of the discharge electrode other than a surface in contact with the dielectric body being coated with a protective layer made of a metal that is gold or a combination of gold and nickel.

Since gold is stable with time and is highly protective against discharge, gold is preferably used for the protective layer. Further, in a case where the protective layer is made of gold and nickel, even when the discharge electrode is made of a material such as silver palladium to which it is difficult to directly form gold (it is difficult to directly make gold plating), by providing a nickel layer (making nickel plating), it is possible to form a protective layer whose uppermost layer is gold.

Further, the ion generating device of the present invention is an ion generating device, including: a discharge electrode on a dielectric body; and an inductive electrode on a plane of the dielectric body that is opposite to a plane where the discharge electrode is formed, the ion generating device generating ions through creeping discharge caused by applying a voltage across the discharge electrode and the inductive electrode so that a potential difference exists between the discharge electrode and the inductive electrode, a surface of the discharge electrode other than a surface in contact with the dielectric body being coated with a protective layer made of a metal.

The ion generating device of the present invention may be arranged so that the metal of which the protective layer is made has lower electric resistance than that of a material for the discharge electrode.

With the arrangement, the metal constituting the protective layer has lower electric resistance (volume resistance) than that of the material for the discharge electrode. This allows preventing non-uniformity in discharge.

The ion generating device of the present invention may be arranged so that the discharge electrode is made of a material whose main component is gold or a material whose main component is tungsten.

With the arrangement, the discharge electrode is made of a material whose main component is gold or a material whose main component is tungsten. Since these materials have lower electric resistance than a material for the discharge electrode such as silver palladium, it is possible to reduce an influence of voids in the discharge electrode. Further, the material whose main component is gold or the material whose main component is tungsten is less likely to be oxidized than a material whose main component is silver or silver palladium, and can reduce deterioration due to discharge energy compared with the material whose main component is silver or silver palladium.

The ion generating device of the present invention may be arranged so that a surface of the discharge electrode other than the surface coated with the protective layer is embedded in the dielectric body.

With the arrangement, in a case where the surface of the discharge electrode other than the surface coated with the protective layer is embedded in the dielectric body, ends of the discharge sections where discharge energy is concentrated are protected by the dielectric body, compared with a case where the discharge electrode is exposed from the dielectric body. This allows the ion generating device to have a longer life.

As described above, the ion generating device of the present invention is an ion generating device, including: a discharge electrode on a dielectric body; and an inductive electrode on a plane of the dielectric body that is opposite to a plane where the discharge electrode is formed, the ion generating device generating ions through creeping discharge caused by applying a voltage across the discharge electrode and the inductive electrode so that a potential difference exists between the discharge electrode and the inductive electrode, a surface of the discharge electrode other than a surface in contact with the dielectric body being exposed to an atmosphere and a surface of the discharge electrode other than the surface exposed to the atmosphere being embedded in the dielectric body.

With the arrangement, the surface of the discharge electrode other than the surface in contact with the dielectric body is exposed to the atmosphere, i.e. the discharge electrode is not provided with a protective layer, and the surface other than the surface exposed to the atmosphere is embedded in the dielectric body. This allows the ion generating device to generate ions evenly and stably, and to have a loner life (better durability).

Further, The ion generating device of the present invention may be arranged so that the discharge electrode is made of a material whose main component is gold or a material whose main component is tungsten. Since these materials have lower electric resistance than a material for the discharge electrode such as silver palladium, it is possible to reduce an influence of voids in the discharge electrode. Further, the material whose main component is gold or the material whose main component is tungsten is less likely to be oxidized than a material whose main component is silver or silver palladium, and can reduce deterioration due to discharge energy compared with the material whose main component is silver or silver palladium. Further, it is preferable that the discharge electrode is made of a material whose main component is gold. The material whose main component is gold is less likely to be oxidized and can reduce deterioration due to discharge energy.

The ion generating device of the present invention may be arranged so that when the discharge electrode and the inductive electrode are projected in a direction in which the discharge electrode and the inductive electrode are laminated, the projected discharge electrode and the projected inductive electrode do not overlap at all.

With the arrangement, in a case where the discharge electrode and the inductive electrode projected in lamination directions do not have common area (the discharge electrode and the inductive electrode do not overlap), discharge at a base section (positioned further from the inductive electrode) of the discharge electrode that is other than the discharge sections is prevented since the inductive electrode does not exist under the base section unlike a case where the discharge electrode and the inductive electrode overlap. This allows the ion generating device to have a longer life.

The ion generating device of the present invention may be arranged so that the discharge electrode includes a base section and discharge sections that protrude from the base section in a direction perpendicular to a long direction of the discharge electrode and perpendicular to a direction in which the discharge electrode is laminated, and a relation $W/H \geqq 0.6$ being satisfied, where W is a width of the base section in the direction perpendicular to the long direction of the discharge electrode and perpendicular to the direction in which the discharge electrode is laminated, and H is a width of the discharge electrode as a whole in the direction perpendicular to the long direction of the discharge electrode and perpendicular to the direction in which the discharge electrode is laminated.

In a case where a ratio of the width W of the base section to the width H of the discharge electrode as a whole is small, when the discharge sections are oxidized due to discharge energy, the oxidization also influences the base section, resulting in breakage of the base section. In contrast thereto, with the arrangement, causing the ratio of the width W to the width H to be larger allows prevention of breakage of the base section and allows the ion generating device to have a longer life.

The method of the present invention for producing an ion generating device is a method for producing an ion generating device that includes: a discharge electrode on a dielectric body; and an inductive electrode on a plane of the dielectric body that is opposite to a plane where the discharge electrode is formed, and that generates ions through creeping discharge caused by applying a voltage across the discharge electrode and the inductive electrode so that a potential difference exists between the discharge electrode and the inductive electrode, the method comprising the step of forming, through plating, a protective layer for coating a surface of the discharge electrode other than a surface in contact with the dielectric body.

With the method, formation of the protective layer through plating allows a protective layer that is thinner and more even than a conventional protective layer and that is free from pinholes, cracks, and voids. Consequently, it is possible to produce an ion generating device that is capable of generating ions evenly and stably and that has a longer life (better durability).

The charging device of the present invention is a charging device, including any one of the aforementioned ion generating devices and voltage applying means for applying a voltage across the discharge electrode and the inductive electrode so that a potential difference exists between the discharge electrode and the inductive electrode.

With the arrangement, it is possible to provide a charging device that includes any one of the ion generating devices of the present invention and thus is capable of charging a charge receiving material stably, effectively, and evenly and has a long life.

The image forming apparatus of the present invention includes the charging device as a charging device for charging an electrostatic latent image bearing member.

By using a charging device of the present invention as a charging device for charging an electrostatic latent image bearing member, it is possible to provide an image forming apparatus that can suitably charge an electrostatic latent image bearing member and that has a long life.

The image forming apparatus of the present invention includes the charging device as a pre-transfer charging device for applying an electric charge to a toner borne on a bearing member.

The charging device of the present invention allows appropriately and suitably charging a toner before transfer, thereby increasing transfer efficiency and uniformity in transfer.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

The present invention is applicable to: a pre-transfer charging device for charging a toner image on an image bearing member such as a photoreceptor and an intermediate transfer member before the toner image is transferred; a latent image charging device for charging a photoreceptor; or an auxiliary charging device for assisting charging a toner in a developing device.

What is claimed is:

1. An ion generating device, comprising:

a discharge electrode on a dielectric body; and an inductive electrode on a plane of the dielectric body that is opposite to a plane where the discharge electrode is formed, the ion generating device generating ions through creeping discharge caused by applying a voltage across the discharge electrode and the inductive electrode so that a potential difference exists between the discharge electrode and the inductive electrode, a surface of the discharge electrode other than a surface in contact with the dielectric body being coated with a protective layer made of a metal that is gold or a combination of gold and nickel, wherein the surface of the discharge electrode other than the surface coated with the protective layer is embedded in the dielectric body.

* * * * *